US011205825B2

(12) United States Patent
Nelson

(10) Patent No.: US 11,205,825 B2
(45) **Date of Patent: *Dec. 21, 2021**

(54) NON-CONTACT TYPE COAXIAL SWITCH

(71) Applicant: Victor Nelson, Deer Park, NY (US)

(72) Inventor: Victor Nelson, Deer Park, NY (US)

( * ) Notice: Subject to any disclaimer, the term of this patent is extended or adjusted under 35 U.S.C. 154(b) by 496 days.

This patent is subject to a terminal disclaimer.

(21) Appl. No.: 16/132,551

(22) Filed: Sep. 17, 2018

(65) Prior Publication Data

US 2019/0296411 A1 Sep. 26, 2019

Related U.S. Application Data

(63) Continuation-in-part of application No. 15/933,638, filed on Mar. 23, 2018, now abandoned.

(60) Provisional application No. 62/670,045, filed on May 11, 2018.

(51) Int. Cl.

| | |
|---|---|
| ***H01P 1/12*** | (2006.01) |
| ***H01R 13/70*** | (2006.01) |
| ***H01P 5/16*** | (2006.01) |

(52) U.S. Cl.

CPC ..... *H01P 1/125* (2013.01); *H01P 5/16* (2013.01); *H01R 13/70* (2013.01)

(58) Field of Classification Search

CPC . H01P 1/125; H01P 1/122; H01P 5/16; H01R 13/70; H01H 3/00

See application file for complete search history.

(56) References Cited

U.S. PATENT DOCUMENTS

| | | | | |
|---|---|---|---|---|
| 2,697,767 A | | 12/1954 | Charles | |
| 2,749,524 A | | 6/1956 | Derosa | |
| 4,617,538 A | * | 10/1986 | Nelson | H01P 1/12 333/106 |
| 4,908,589 A | | 3/1990 | Basil | |
| 4,945,320 A | * | 7/1990 | Hettlage | H01P 1/122 333/106 |
| 4,967,170 A | | 10/1990 | Hettlage | |
| 5,451,918 A | | 9/1995 | Sun | |

(Continued)

*Primary Examiner* — Suman K Nath
(74) *Attorney, Agent, or Firm* — Edwin D. Schindler

(57) ABSTRACT

A non-contact type coaxial switch that eliminates all contacts and inner conductors. The switch includes a stator/coax base assembly and a rotor. The stator/coax base assembly is fixed, while the rotor is rotatably mounted to the stator/coax base assembly and eliminates all contacts and inner conductors. The rotor is disposed between bearings, and consists of waveguide paths that couple between selected coax connectors. When the rotor is rotated, different selected coax connectors occur. For other arrangements selected, the rotor can switch between a condition of coax and waveguide outputs. The rotor, between bearings, consists of waveguide paths which couple between selected coax connectors. When the rotor is rotated, a different selected coax connector occurs. For other arrangements selected, the rotor can switch between a combination of coax and waveguide outputs. The switch can assume many configurations. For example, a Double-Pole-Double-Throw (DPDT) configuration; a 3 and 4 Way R-Type configuration; a Single-Pole-Multiple-Throw (SPMT) configuration; a T-Switch configuration; and a Multiple-Pole-Multiple-Throw (MPMT) configuration.

16 Claims, 33 Drawing Sheets

(56) References Cited

U.S. PATENT DOCUMENTS

| | | | |
|---|---|---|---|
| 5,519,253 | A | 5/1996 | Lake |
| 5,563,447 | A | 10/1996 | Lake |
| 6,667,671 | B1 | 12/2003 | Speldrich |

* cited by examiner

NON-CONTACT TYPE COAXIAL SWITCH

CROSS REFERENCE TO RELATED APPLICATIONS

The instant non-provisional patent application is a CIP of non-provisional patent application Ser. No. 15/993,638, filed on May 31, 2018, and entitled a NON-CONTACT TYPE COAXIAL SWITCH, and which claims priority from provisional application No. 62/670,045, filed on May 11, 2018, and entitled NON-CONTACT TYPE COAXIAL SWITCH, and both are incorporated herein in their entireties by reference thereto.

BACKGROUND OF THE INVENTION

Field of the Invention

The embodiments of the present invention relate to a coaxial switch, and more particularly, the embodiments of the present invention relate to a non-contact type coaxial switch to be used at high frequencies when conventional contact type coax switches do not perform as the present invention.

Description of the Prior Art

Conventional coaxial switches are known to have several limitations. The most severe being power handling capability. The maximum average power that a conventional coaxial switch can handle is typically limited by overheating of the internal switch materials due to RF losses.

Typical Coax Switches use contact bars to transmit the signal between two coax connectors, as shown in FIGS. 1 and 2.

Conventional designs typically exhibit poor thermal conductivity from the transmission line center conductor. Poor thermal conductivity can lead to excessive heat build-up, which can cause the safe operating temperatures of the materials being used to be exceeded resulting in failures.

Further, the peak power of conventional coaxial switches are limited by multipacting breakdown. Multipacting breakdown is a resonant radio frequency discharge that is attributable to secondary emissions of electrons from discharging surfaces when a radio frequency field of sufficient magnitude and proper frequency is applied across a gap in a vacuum. Multipacting causes disruption of communications and if not controlled can lead to destruction of the switch.

Many coaxial switches of conventional design are inclined to suffer from multipacting breakdown at low power levels and certain (i.e. L and C) frequency ranges. As a result, many current applications are increasingly requiring power handling capabilities beyond those of such conventional coaxial switches.

Conventional coaxial switches are also generally more mechanically complex than other designs. As a result, many switch configurations, though realizable, are difficult and costly to implement in a conventional coaxial design.

In the communication or Military Industries, there is a need for reliable coaxial switches in frequency bands beyond 25 GHz and the need for handling higher power. Contact devices are vulnerable to repeat consistent performance.

Existing coax switches with contacts fall short in performance at frequencies beyond 30 GHz. Often for switching they must use a waveguide switch at these frequencies.

As shown in FIGS. 2A and 2B, typical waveguide transfer switches use a waveguide rotor moving inside a waveguide housing to transfer microwave energy between two waveguide ports.

Conventional coax switches, with contacts, have various limitations at high frequencies exceeding 20 GHz. They suffer from:

- Performance loss, high VSWR, and low isolation; all key parameters of quality switches;
- Reliability—contacting devices at these frequencies introduce erratic results;
- High power concerns. Contacts in typical switches are prone to overheat, weld together, arc, or become intermittent, limiting the RF power applied or producing undesired results;
- Peak power concerns—Contact devices are prone to arcing or multipacting or adding undesired noise into transmission intelligence;
- Life—The requirement for frequent switching is limited to as a result of contacting self-destruction;
- RF High Frequency and modest to high RF power—the industry is forced to use waveguide switches with bulky wave guides, leading to size and complexity;

In contradistinction, however, the embodiments of the present invention allow industry to use coaxial lines, rather than waveguides, to feed the switching device, described herein, whose principle switching means is a waveguide switch, which eliminates the various problems of high frequency coaxial switches of conventional design.

Numerous innovations for coaxial switches have been provided in the prior art, which are adapted to be used, and which are discussed, infra, in chronological order to show advancement in the art. Even though these innovations may be suitable for the specific individual purposes to which they address, they would not be suitable for the purposes of the embodiments of the present invention as heretofore described, namely, a non-contact type coaxial switch. For example:

DowKey Microwave Switch and RF Relay

The Type HO Coaxial Transfer Switches have RF geometry optimized for 3.5 mm connectors over a 0-26.5 GHz frequency band. The latching model is magnetically latched, and can be with or without an actuator cutoff circuit. Both latching and failsafe models can be with or without indicators.

A single voltage pulse of 20 milliseconds is required to change positions. No holding power is required to maintain a position.

The failsafe model includes a dual magnetic field. The Type HO Coaxial Transfer Switches have limited and deteriorative performance, and for a contact type coax switch, has a frequency limit of 26.5 GHz.

The performance of DowKey deteriorates >20 GHz, while the present invention provides excellent results for 26-40 GHz.

In contradistinction, however, the embodiments of the present invention are a non-contact type coax switch that can operate in a range of 26-40 GHz, and with small changes in the rotor, can handle other frequency ranges.

U.S. Pat. No. 2,697,767 to Charles

U.S. Pat. No. 2,697,767—issued to Charles on Dec. 21, 1954 in U.S. class 200 and subclass 155—teaches a radio frequency switch. The switch includes a switch body having therein a socket with a metallic surface, at least two radio frequency line connections in an axially aligned position in the switch body extending to the socket surface, and a movable switch member having a longitudinally extended open sided metallic walled radio frequency line cavity therein arranged to connect two of the radio frequency line connections in one switch position. The member is mounted in the socket and together with the metallic socket surface provides in the one switch position an enclosed radio frequency line of uniform impedance with the metallic socket surface forming a continuous unbroken longitudinal portion of the boundary of the line and with the outer peripheral edge of the cavity substantially flush throughout its entire length with the switch body in the one switch position, so that the switch provides in the one position a radio frequency line of uniform impedance throughout its length with a continuous conducting path along the boundary of the line.

U.S. Pat. No. 2,749,524 to Derosa

U.S. Pat. No. 2,749,524—issued to Derosa on Jun. 5, 1956 in U.S. class 333 and subclass 97—teaches a switching device for coupling high frequency electromagnetic energy sequentially between a given one and the others of a plurality of coaxial connectors. The switch device includes a conductor body having an extended surface connected to the outer conductors of the coaxial connectors, a plurality of sector conductors and apparatus disposing the sector conductors in close spaced substantially parallel relation to the surface. The spacing of the sector conductors, with respect to the surface, is a fraction of the radial spacing of the inner and outer conductors of the coaxial connectors. The switch device further includes apparatus coupling each of the sector conductors to the inner conductor line of the coaxial connectors and a movable conductor coupled to the inner conductor of the given connector for movement in coupled relation to the sector connectors to electrically couple the sector conductors sequentially to the given connector.

Derosa et al. uses contacts to switch energy.

In contradistinction, however, the embodiments of the present invention use no contacts or conductors coupled to contacts. The embodiments of the present invention have a waveguide rotor changes switching paths not utilizing sector conductors as used by Derosa et al.

U.S. Pat. No. 4,908,589 to Basil Jr. et al.

U.S. Pat. No. 4,908,589—issued to Basil Jr. et al. on Mar. 13, 1990 in U.S. class 333 and subclass 106—teaches a dielectrically loaded waveguide switch that provides high power handling capability, small size, and low weight. The switch includes first and second dielectrically loaded waveguides selectively connected by a switch. In a specific embodiment of the switch, the switch includes a third dielectrically loaded waveguide mounted for communication with the first and second waveguides upon switch actuation.

Basil teaches a typical coax switch with 4 adaptions mounted to a typical waveguide switch with dielectric loading.

In contradistinction, however, the embodiments of the present invention teach coax outputs as a part of a waveguide structure consisting of mini-rotors to produce an inherent device that is much smaller with better performance to produce a true coaxial switch.

Further, the embodiments of the present invention are small coaxial switches with no contacting apparatus, higher power capability, extended frequency application, and outstanding reliability.

Basil is a typical coax with four adaptors mounted to a typical waveguide switch with dielectric loading.

In contradistinction, however, the embodiments of the present invention provide coax outputs, a part of a waveguide structure consisting of mini-rotors to provide an inherent device, which is much smaller with better performance. The embodiments of the present invention are true coax switches.

The embodiments of the present invention are small coax switches with the following:

No contacting apparatus;
Higher power capability;
Extended frequency application up to 40 GHz;
Outstanding reliability as a result of no contacting;
A range limited to the range of the waveguide rotor path;
A waveguide path designed for high frequencies (26 GHz to 40 GHz), where typical coax switches falter;
Coax inputs are internally part of the waveguide assembly;
The waveguide switch has rotors to accommodate coaxial inputs;
Full RF power capability as to element contacts; and
Various configurations, including all coax or some waveguide connections.

U.S. Pat. No. 4,967,170 to Hettlage et al.

U.S. Pat. No. 4,967,170—issued to Hettlage et al. on Oct. 30, 1990 in U.S. class 333 and subclass 106—teaches a waveguide switch with four outputs or inputs normally having one rotor with three passages with which, as appropriate, two waveguide connections can be effected in specific rotor positions. In two switching positions only the central waveguide passage conducts HF signals, whereas in the two other switching positions both curved passages simultaneously conduct HF signals. Whereas, the transmission losses in the central passage are low, a very high reflection level has hitherto been obtained in the two curved passages because of the points of inflexion. In order to improve the transmission characteristics, the curved passages have an elliptical shape. For this, the longitudinal passage is narrowed toward the central point of the rotor, so that sufficient space is provided for the curved portion of the lateral passages. The circular shape of the curved passages can also be approximated by a facet-like shaping of the sidewalls. The points of inflexion thus created result in only insignificant changes in the transmission characteristics.

Hettlage et al. is an ordinary waveguide switch having full walls with inherent tuning. It is not applicable to the embodiments of the present invention, and is for a contact coaxial switch.

U.S. Pat. No. 5,451,918 to Sun

U.S. Pat. No. 5,451,918—issued to Sun on Sep. 19, 1995 in U.S. class 335 and subclass 4—teaches a microwave multi-port switch having three operating positions and three RF paths. Six peripheral contact junctions are provided adjacent corners of a hexagonal cavity in an RF body and a common contact is provided at the cavity center. Six reeds bridge over in and out of contact with adjacent ones of the peripheral contacts, and six reeds extend between and in and out of contact with the peripheral contacts and the common contact. Reeds are actuated by movement of a coil-driven rocker through three actuating mechanisms, including a center post at three levels above the body. The mechanisms include radially extending leaf springs, an actuator loosely keyed to the center post, and a pivoted leaf spring movable by rocker tilting depressing the actuator. The leaf springs and fixed dielectric posts extend upwardly from the reeds.

Sun is a contact-type coaxial switch.

In contradistinction, however, the embodiments of the present invention eliminate all contacts and inner conductors, and as such, there is no physical contacts to operate the coax switch. Switching the w.g path allows coupling to other paths therewithin.

U.S. Pat. No. 5,519,253 to Lake et al.

U.S. Pat. No. 5,519,253—issued to Lake et al. on May 21, 1996 in U.S. class 257 and subclass 724—teaches a low inductance coaxial semiconductor switching module and methods of operating same. The module can contains high power, high frequency semiconductor switching device, operated to provide high power at low inductance. The module incorporates compositional geometrical and electrical symmetry in a coaxial configuration. The module also includes short internal leads, a special circumferential array of substrates, a special circular gate circuit, a special circular Kelvin circuit, a special terminal subassembly, and special module mounting features.

Lake ('253) is a solid state switch using semiconductors to open or close electronically to provide switching. It has high speed and is very loose.

In contradistinction, however, the embodiments of the present invention are non-contact type coaxial switches; entirely different structures.

U.S. Pat. No. 5,563,447 to Lake et al.

U.S. Pat. No. 5,563,447—issued to Lake et al. on Oct. 8, 1996 in U.S. class 257 and subclass 724—teaches a high power module containing high power, high frequency semiconductor switching devices and methods of operating same that provide high power and low inductance. The module incorporates compositional, geometrical and electrical symmetry. The module also includes short internal leads, special IC chip substrates, trimmable gate lead resistances, a special composite metal/ceramic baseplate, and a special terminal conductor overlap.

Lake ('447) is a solid state switch using semiconductors accommodating various circuitry and DC power.

U.S. Pat. No. 6,667,671 to Speldrich et al.

U.S. Pat. No. 6,667,671—issued to Speldrich et al. on Dec. 23, 2003 in U.S. class 333 and subclass 106—teaches a waveguide switch having a stator and an electrically conducting movable element. The stator has waveguide paths between waveguide terminal pairs. Each path is switchable to conducting or nonconducting with the help of the movable element for high-frequency waves. To permit lower requirements regarding manufacturing tolerances, the movable element is designed as a septum in a gap in the stator and extends in the waveguide path that is switched to nonconducting, in parallel to its E plane. This divides the waveguide path into two partial waveguides that run in parallel with one another, and in comparison with the switched-to-conducting state of the waveguide path, have smaller cut-off wavelengths, and an electrically conducting movable element. The stator has waveguide paths between waveguide terminal pairs. Each path is switchable to conducting or nonconducting with the help of the movable element for high-frequency waves. To permit lower requirements regarding manufacturing tolerances, the movable element is designed as a septum in a gap in the stator and extends in the waveguide path that is switched to nonconducting, in parallel to its E plane. This divides the waveguide path into two partial waveguides that run in parallel with one another, and in comparison with the switched-to-conducting state of the waveguide path, have smaller cut-off wavelengths.

Speldrich et al. is purely a waveguide switch with no inherent coax capability and requires adding additional coax adapters to provide coax switching.

It is apparent that numerous innovations for coaxial switches have been provided in the prior art, which are adapted to be used. Furthermore, even though these innovations may be suitable for the specific individual purposes to which they address, however, they would not be suitable for the purposes of the embodiments of the present invention as heretofore described, namely, a non-contact type coaxial switch.

SUMMARY OF THE INVENTION

Thus, an object of the embodiments of the present invention is to provide a non-contact type coaxial switch, which avoids the disadvantages of the prior art.

The present invention has no magnetic contact, but has a rotating waveguide rotor in its place.

The non-contact type coaxial switch is essentially a coax switch that does not use any contact bars to transfer the microwave energy between two coax connectors; it uses a rotor similar to a waveguide one to transfer the signal between two coax connectors. The coax connectors work like an antenna and send the signal through the waveguide channel to the receiving connector.

Combining the signal between and after a waveguide transfer switch involves 3 devices and is quite complex. Using a typical coax switch has its downfalls in terms of not being able to handle high power and is very loosy at high frequencies above 30 GHz. In contradistinction, however, the non-contact type coaxial switch of the present invention is a compact device that allows for such switching capability above 26.5 GHz while being small and light weight. Unlike typical coax switches it has a huge advantage of being contactless and more reliable at high frequencies and at high power.

In another embodiment the non-contact type coaxial switch of the present invention has the capability of switching between one or more waveguide port(s) and coax input(s)/output(s). A plurality of possible combinations can be achieved by the non-contact type coaxial switch of the present invention whereby the switch is not only switching between two paths but these paths do not have to be the same, e.g. a waveguide port or a coax connector.

The bottom housing of the non-contact type coaxial switch of the present invention has a waveguide rotor that pivots inside and can be either a fully-fledged rotor or one that has one or more of its sides cut out.

Briefly stated, another object of the embodiments of the present invention is to provide a non-contact type coaxial switch that eliminates all contacts and inner conductors. The switch includes a stator/coax base assembly and a rotor. The stator/coax base assembly is fixed, while the rotor is rotatably mounted to the stator/coax base assembly and eliminates all contacts and inner conductors. The rotor is disposed between bearings, and consists of waveguide paths that couple between selected coax connectors. When the rotor is rotated, different selected coax connectors occur. For other arrangements selected, the rotor can switch between a condition of coax and waveguide outputs. The rotor, between bearings, consists of waveguide paths which couple between selected coax connectors. When the rotor is rotated, a different selected coax connector occurs. For other arrangements selected, the rotor can switch between a combination of coax and waveguide outputs. The switch can assume many configurations. For example, a Double-Pole-Double-Throw (DPDT) configuration; a 3 and 4 Way R-Type configuration; a Single-Pole-Multiple-Throw (SPMT) configuration; a T-Switch configuration; and a Multiple-Pole-Multiple-Throw (MPMT) configuration.

Still another object of the embodiments of the present invention is to replace contact type devices with non-contact type devices that provide higher power capability, along with reliable and repeatable performance.

Yet another object of the embodiments of the present invention is to supply a waveguide switch with internal coaxial outputs.

Still yet another object of the embodiments of the present invention is to make use of a rotor without the additional side in both the E plane and the H plane waveguide configurations for smaller size units.

Yet still another object of the embodiments of the present invention is that the coaxial concept will work well with a full rotor concept (a larger version) as well as the 3 sided rotor path.

Still yet another object of the embodiments of the present invention is that SMI has developed a combination of a waveguide switch with suitable coaxial outputs or non-contact device.

Yet still another object of the embodiments of the present invention is the formation of a "Cowave" switch which allows for switching at higher frequencies with excellent performance. With one such a switch, one can choose between a combination of waveguide ports or coaxial outputs.

Still yet another object of the embodiments of the present invention is to expand the switch options to include:

1. Non-contact coax switch;
2. Waveguide switch; and
3. The new Cowave that is a hybrid between the above two switches.

As shown in FIG. 14, yet still another object of the embodiments of the present invention is that its rotor can have side walls, a top wall, a bottom wall, or any combination with one or more of these walls, and behaves like a waveguide switching device.

Still yet another object of the embodiments of the present invention is that each port can be a waveguide port or a coaxial connector, and therefore a plurality of combinations of coax switches, waveguide switches, and hybrid combinations of waveguide ports and coaxial connectors are possible.

As shown in FIGS. 15, 16, and 17, yet still another object of the embodiments of the present invention is that the coaxial connector can be mounted from the bottom side of the housing, the outer side of the housing, or the front of the housing.

Still yet another object of the embodiments of the present invention is that the waveguide channels may have single or double ridges, and not just plain rectangular channels.

Yet still another object of the embodiments of the present invention is that the same switch can have multiple rotors stacked on top of each other, so as to be able to form arrays of the switches.

The novel features considered characteristic of the embodiments of the present invention are set forth in the appended claims. The embodiments of the present invention themselves, however, both as to their construction and to their method of operation, together with additional objects and advantages thereof, will be best understood from the following description of the embodiments of the present invention when read and understood in connection with the accompanying figures of the drawing.

BRIEF DESCRIPTION OF THE FIGURES OF THE DRAWING

The figures of the drawing are briefly described as follows.

Double-Pole-Double-Throw (DPDT) Cowave Switch

3 and 4-Way R-TYPE Configuration

Figure 14:
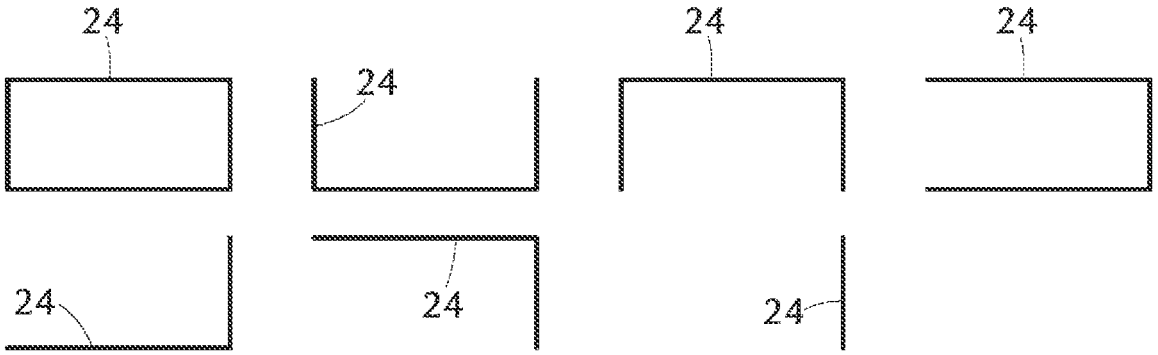
Figure 15A:
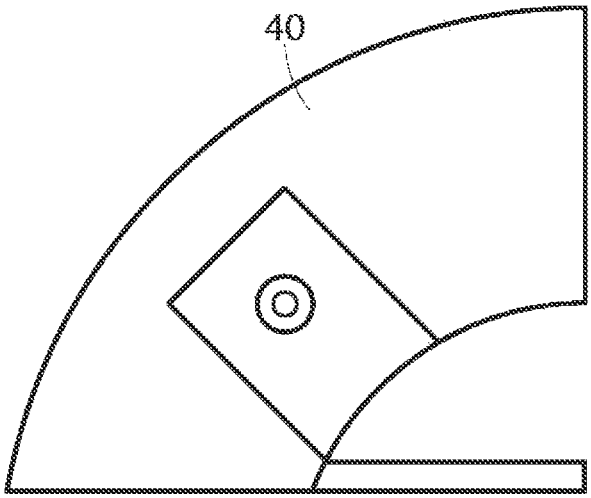
Figure 15B:
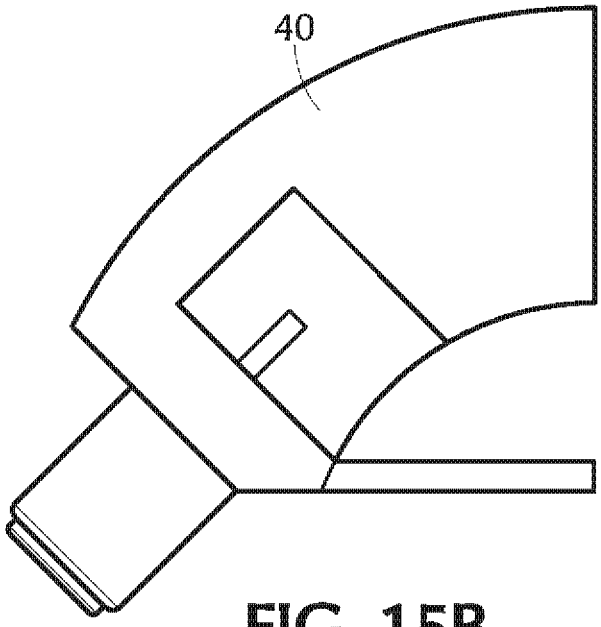
Figure 15C:
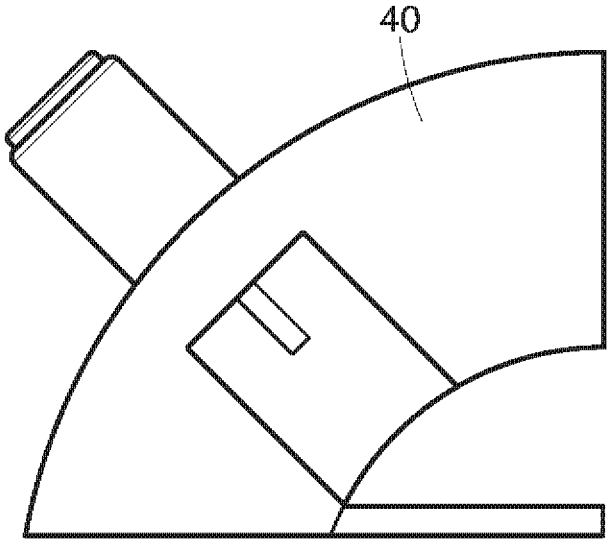
Figure 16A:
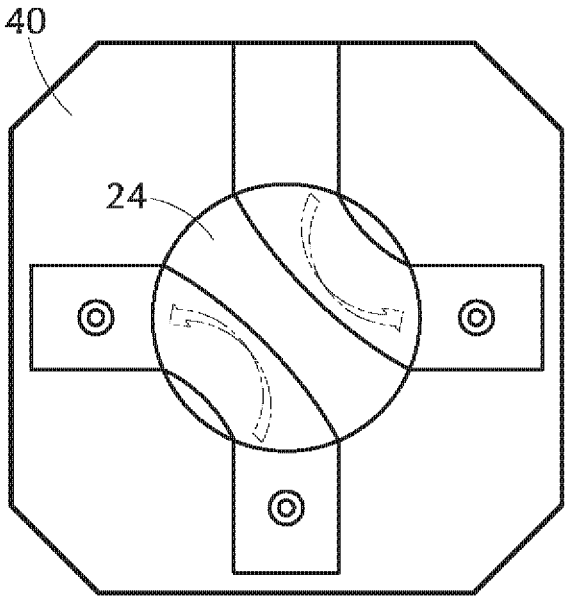
Figure 16B:
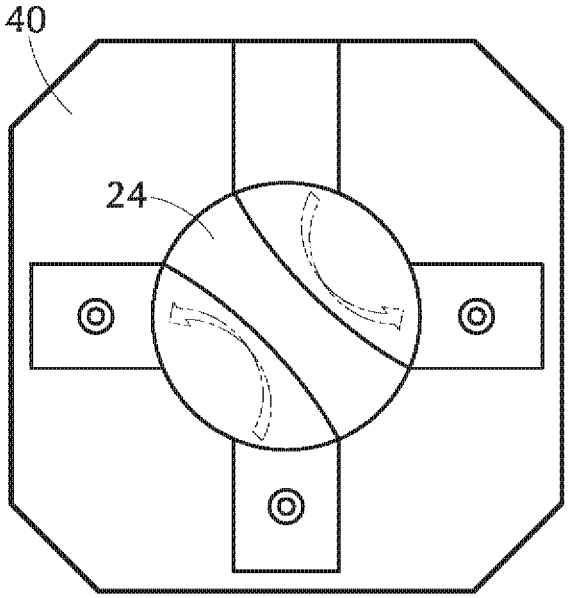
Figure 16C:
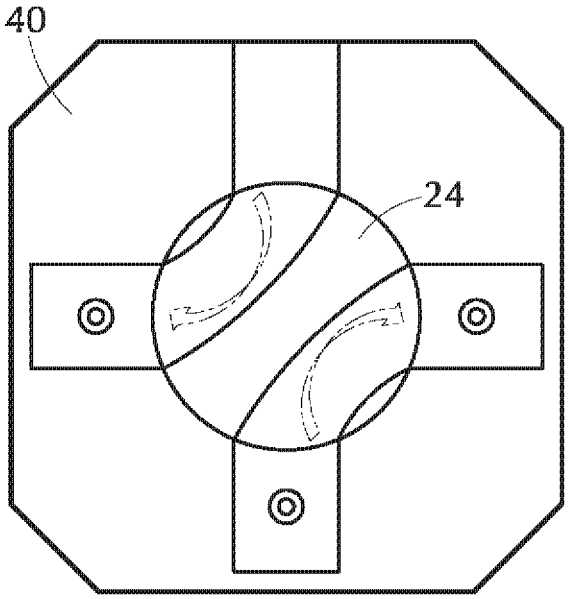
Figure 16D:
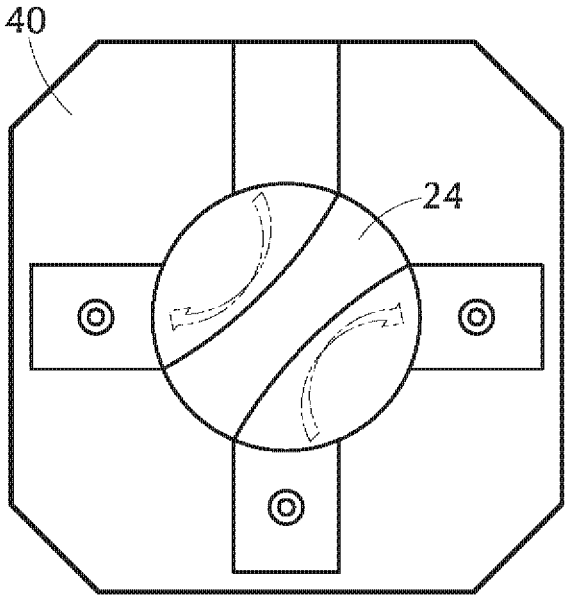
Figure 17A:
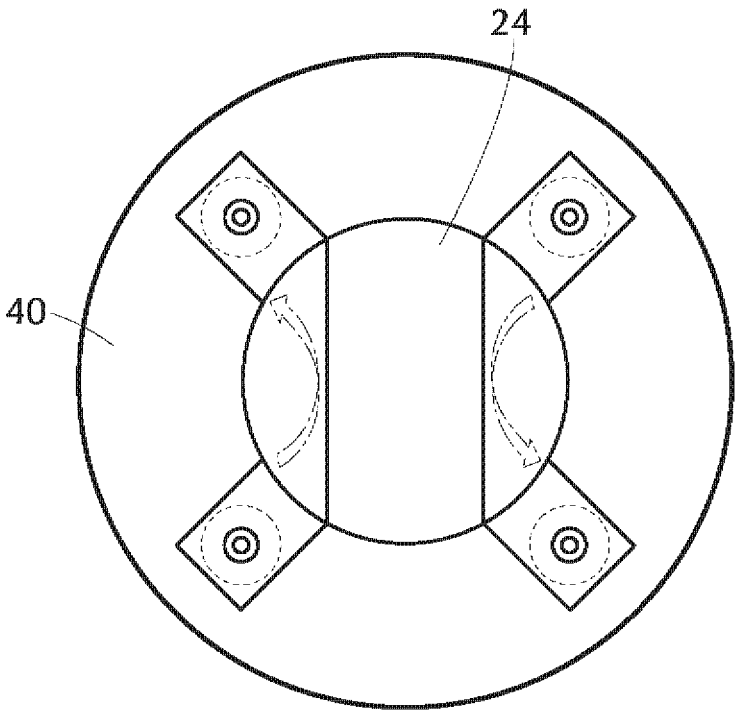
Figure 17B:
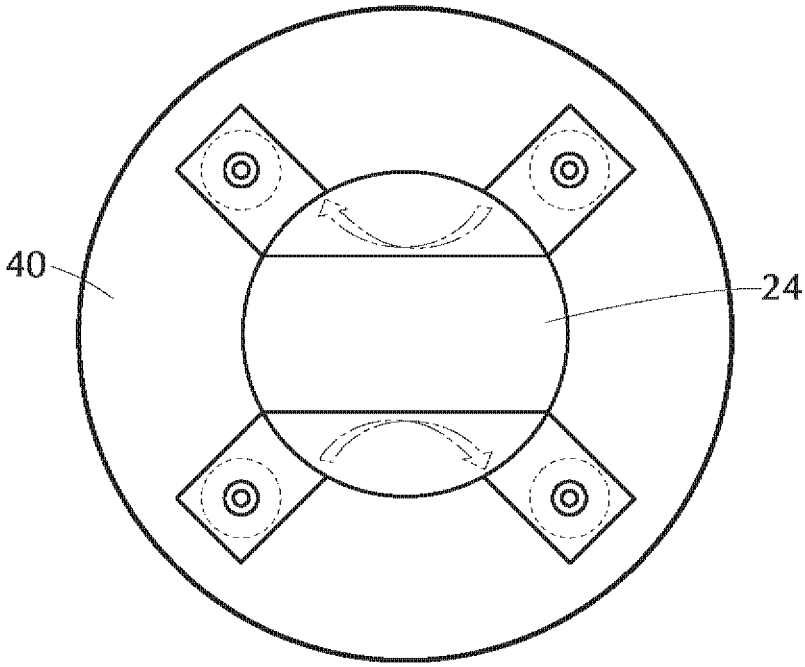
Figure 18A:
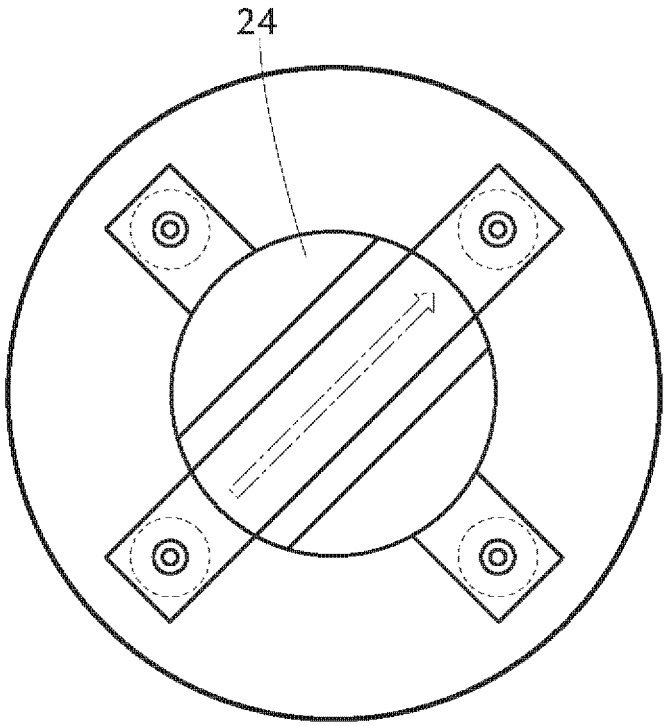
Figure 18B:
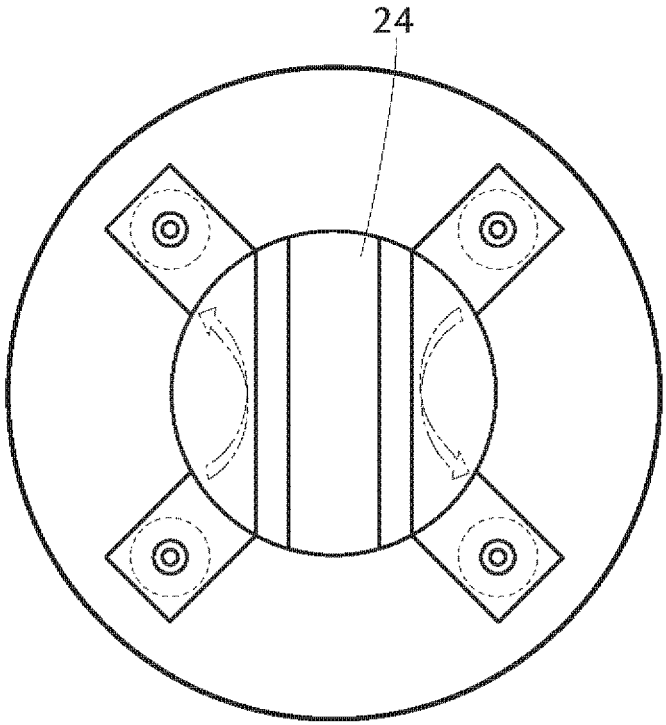
Figure 18C:
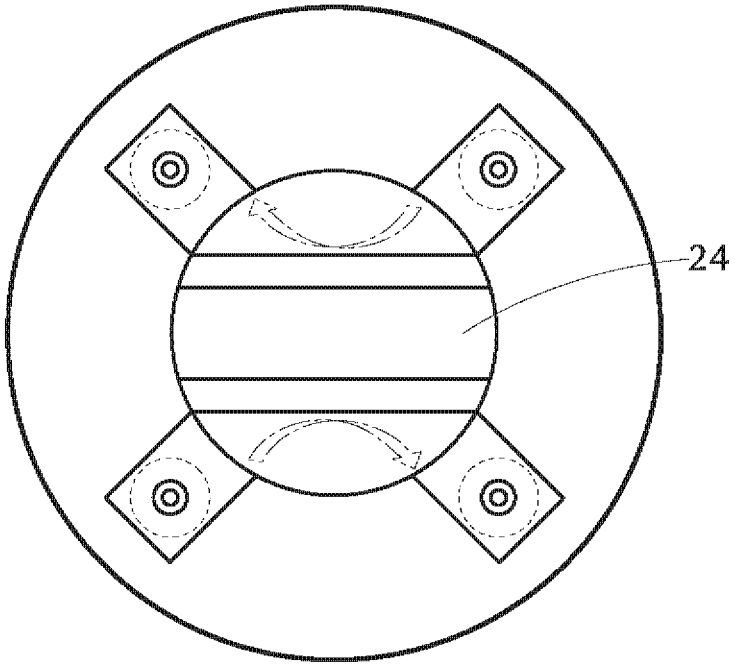
Figure 18D:
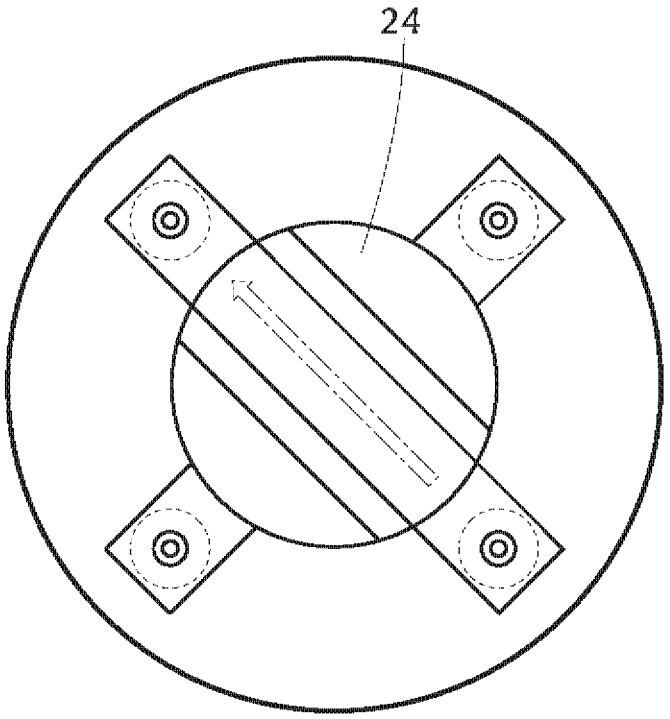
Figure 19A:
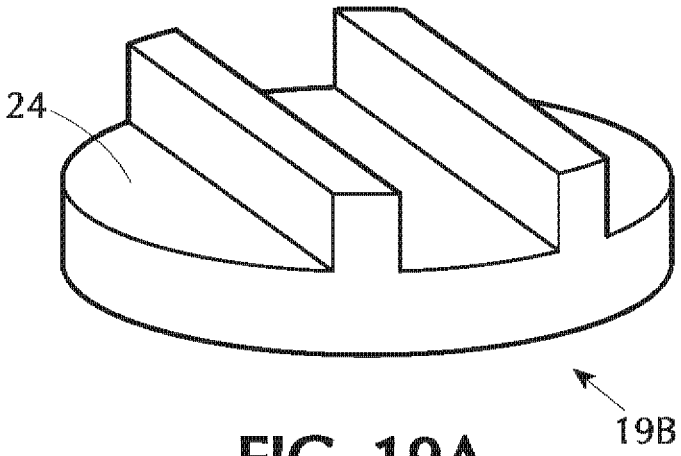
Figure 19B:
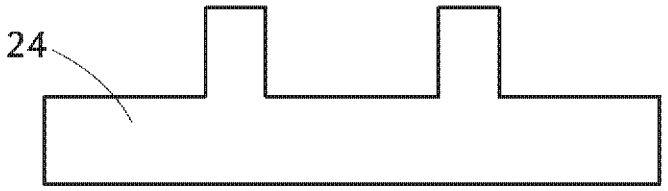

FIG. 14 are diagrammatic views of the different configurations of the waveguide channels;

FIG. 15A is a diagrammatic view of the coax connector mounted from the bottom side of the housing;

FIG. 15B is a diagrammatic view of the coax connector mounted from the outer side of the housing;

FIG. 15C is a diagrammatic view of the coax connector mounted from the front of the housing;

FIG. 16A is a diagrammatic cross sectional view of a curved rotor with curved outer walls for a DPDT switch, and in a first position;

FIG. 16B is a diagrammatic cross sectional view of a curved rotor with no curved outer walls for a DPDT switch, and in a second position;

FIG. 16C is a diagrammatic cross sectional view of a curved rotor with curved outer walls for a DPDT switch, and in a third position;

FIG. 16D is a diagrammatic cross sectional view of a curved rotor with no outer walls for a DPDT switch, and in a fourth position;

FIG. 17A is a diagrammatic cross sectional view of a flat rotor with no outer wall for a DPDT switch, and in a first position;

FIG. 17B is a diagrammatic cross sectional view of a flat rotor with no outer wall for a DPDT switch, and in a transfer position;

FIG. 18A is a diagrammatic cross sectional view of an R-switch having 3 or 4 position switching, adjacent paths, and a through path, and in a first position;

FIG. 18B is a diagrammatic cross sectional view of an R-switch having 3 or 4 position switching, an adjacent path, and through paths, and in a second position;

FIG. 18C is a diagrammatic cross sectional view of an R-switch having 4 coaxial connectors, and in a first position;

FIG. 18D is a diagrammatic cross sectional view of an R-switch having 4 coaxial connectors, and in a second position;

FIG. 19A is a diagrammatic perspective view of a 4-way position rotor with no top wall or side walls;

FIG. 19B is a diagrammatic side elevational view taken in the direction of ARROW 19B in FIG. 19A of a 4-way position rotor with no top wall or side walls;

Single-Pole-Multiple-Throw (SPMT) Configuration

Figure 20A:
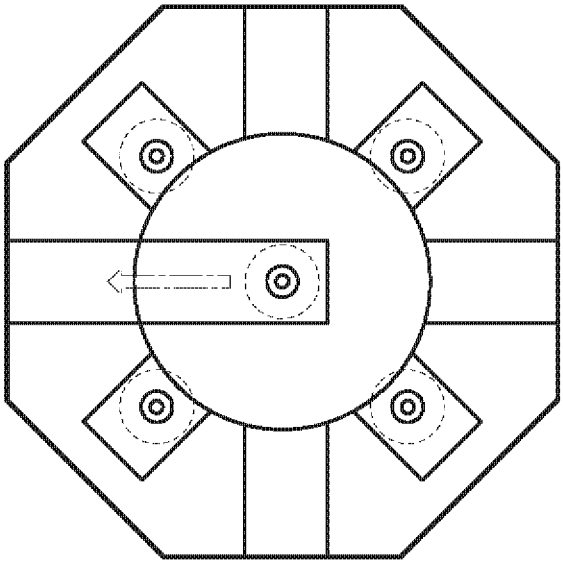
Figure 20B:
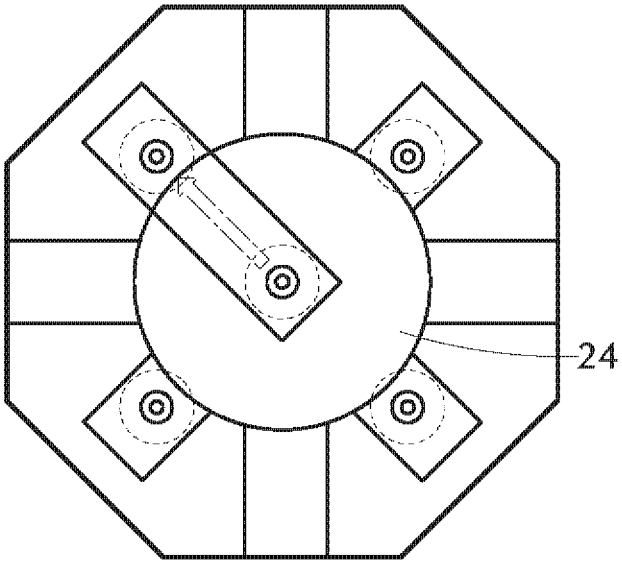
Figure 20C:
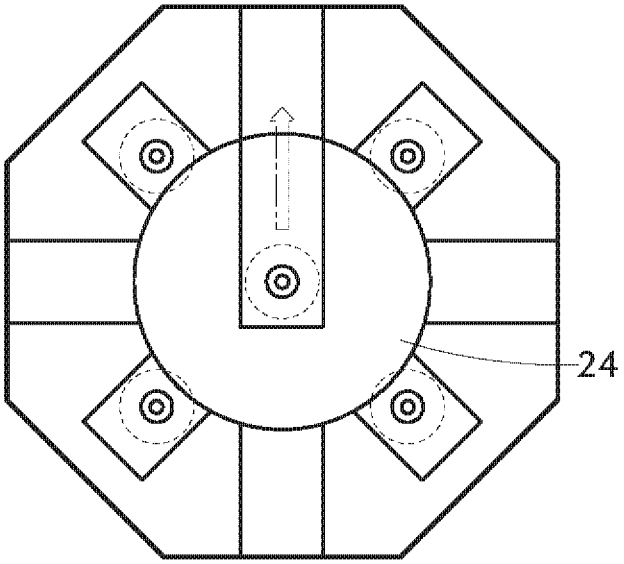
Figure 20D:
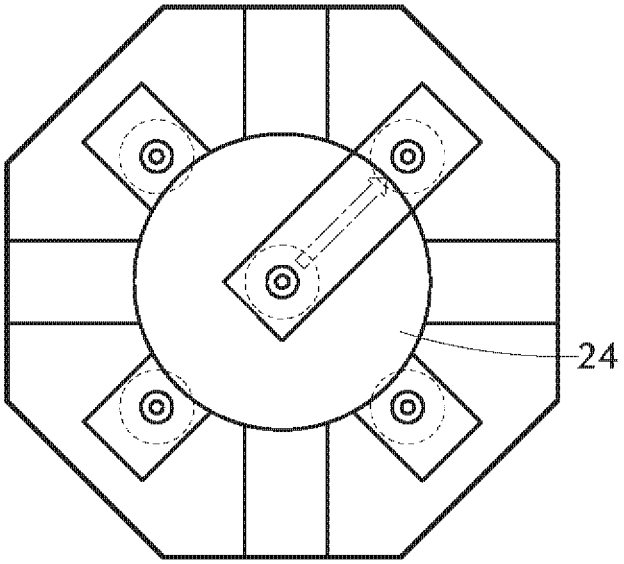
Figure 21A:
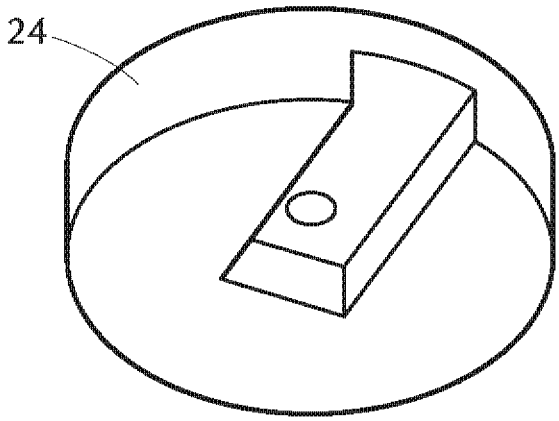
Figure 21B:
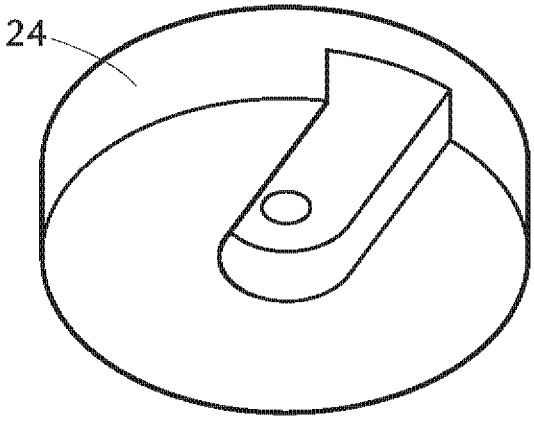

FIG. 20A is a diagrammatic side elevational view of a switch having 4 coaxial connectors and 4 waveguide ports, which provides a single input switchable to "X" output of coax or waveguide ports, and in a first position;

FIG. 20B is a diagrammatic side elevational view of a switch having 4 coaxial connectors and 4 waveguide ports, which provides a single input switchable to "X" output of coax or waveguide ports, and in a second position;

FIG. 20C is a diagrammatic side elevational view of a switch having 4 coaxial connectors and 4 waveguide ports, which provides a single input switchable to "X" output of coax or waveguide ports, and in a third position;

FIG. 20D is a diagrammatic side elevational view of a switch having 4 coaxial connectors and 4 waveguide ports, which provides a single input switchable to "X" output of coax or waveguide ports, and in a fourth position;

FIG. 21A is a diagrammatic perspective view of a SPMT rotor with no bottom wall and having a flat side;

FIG. 21B is a diagrammatic perspective view of a SPMT rotor with no bottom wall and having a curved side;

T-Switch Configuration

Figure 22A:
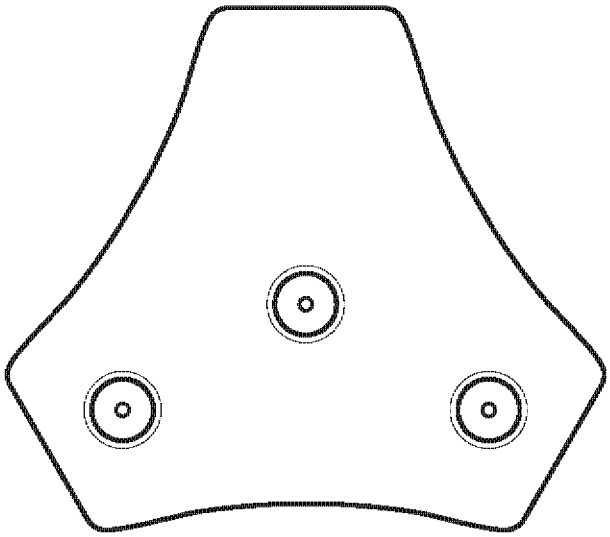
Figure 22B:
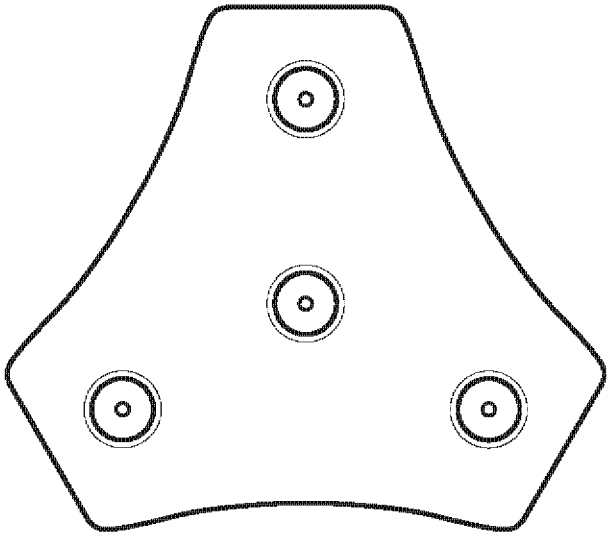
Figure 23:
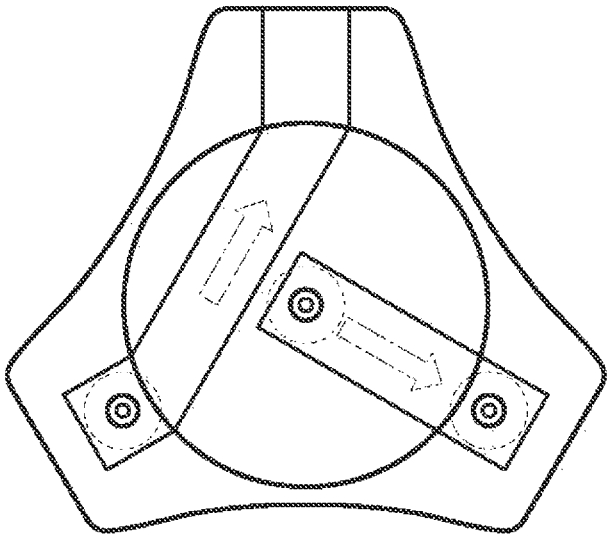
Figure 24:
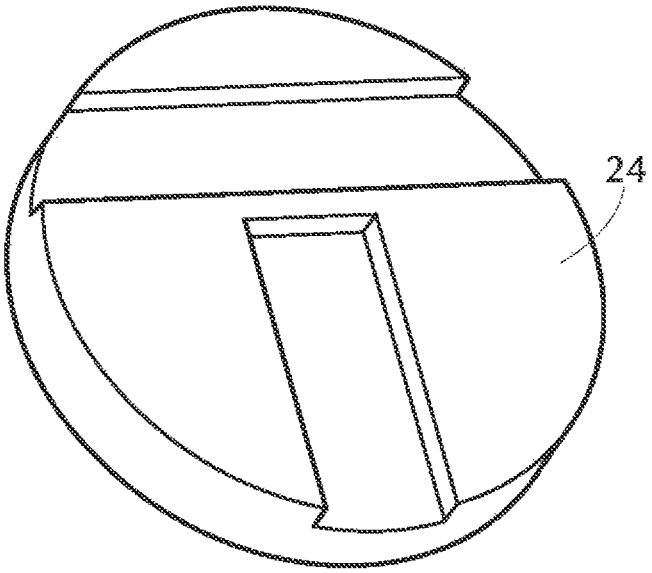
Figure 25A:
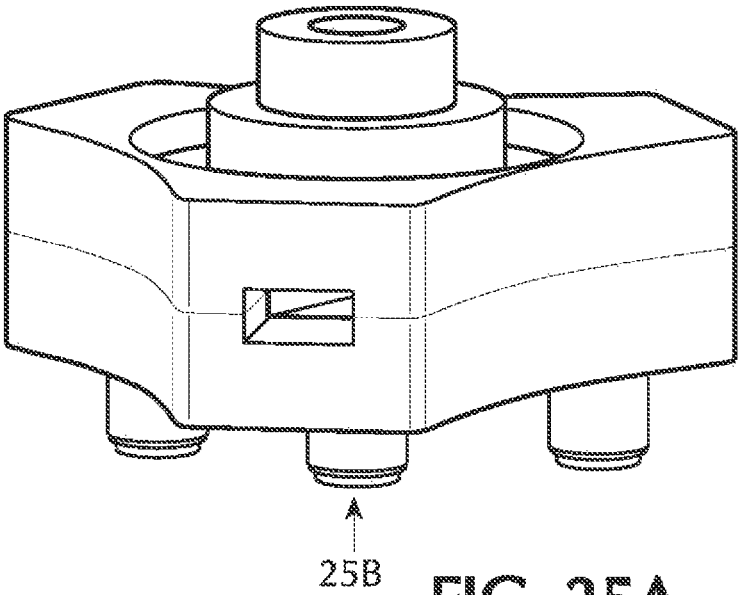
Figure 25B:
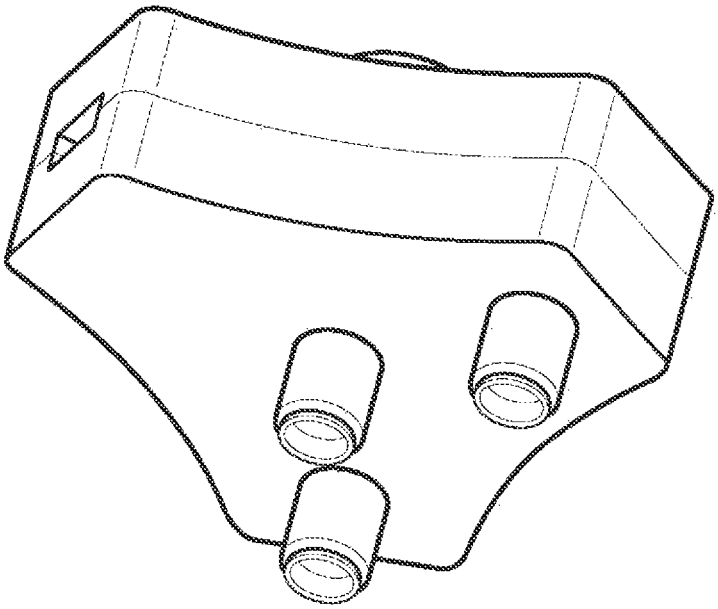
Figure 26A:
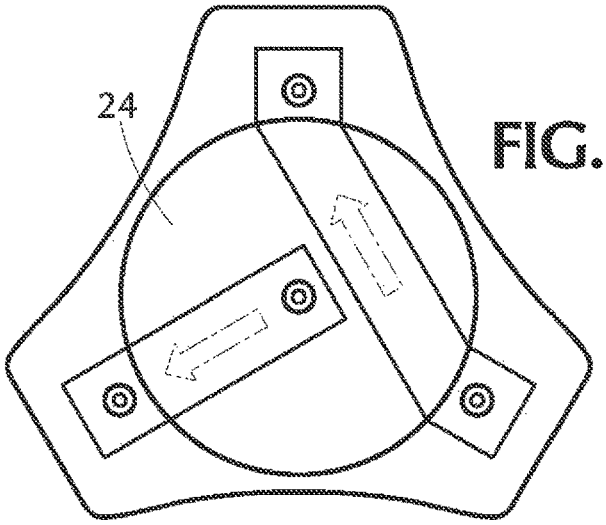
Figure 26B:
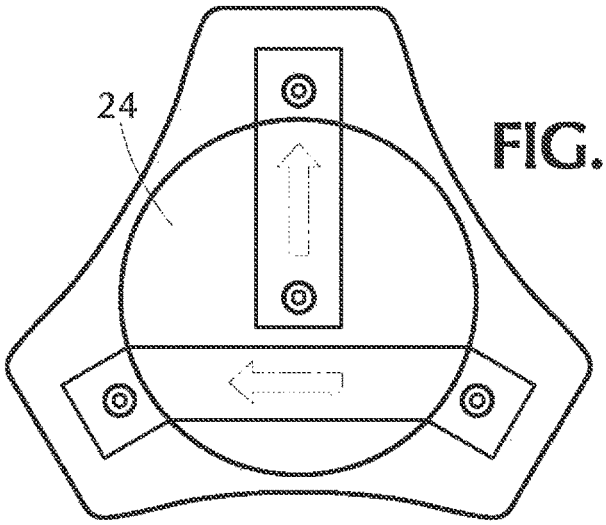
Figure 26C:
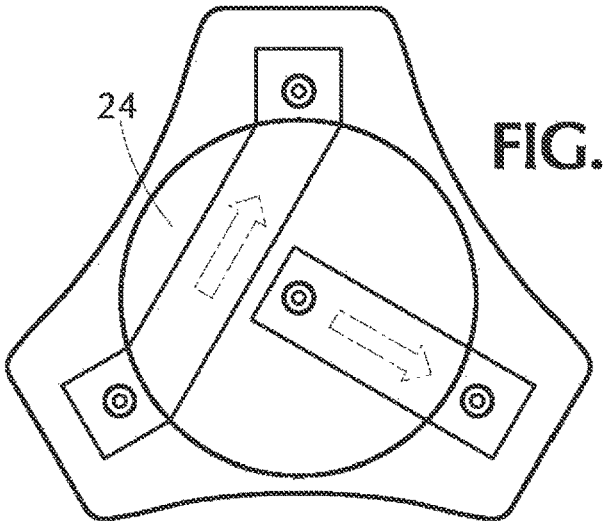
Figure 27A:
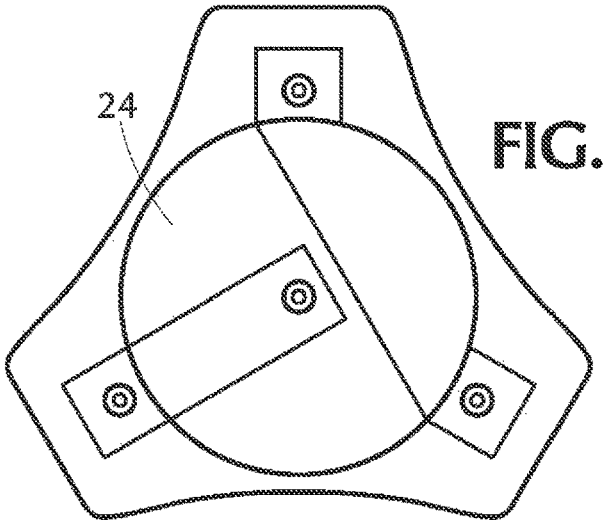
Figure 27B:
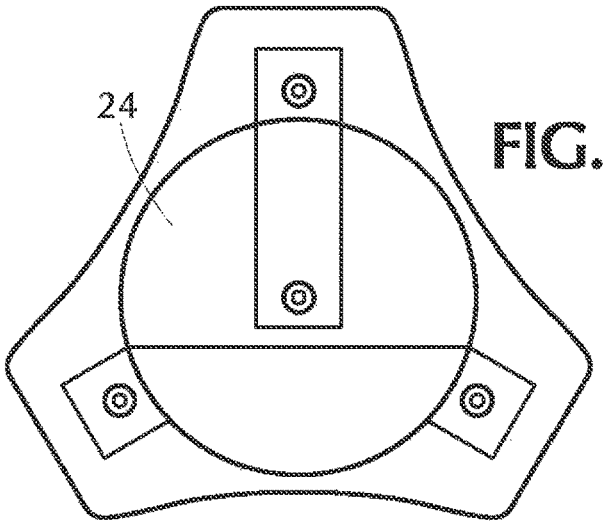
Figure 27C:
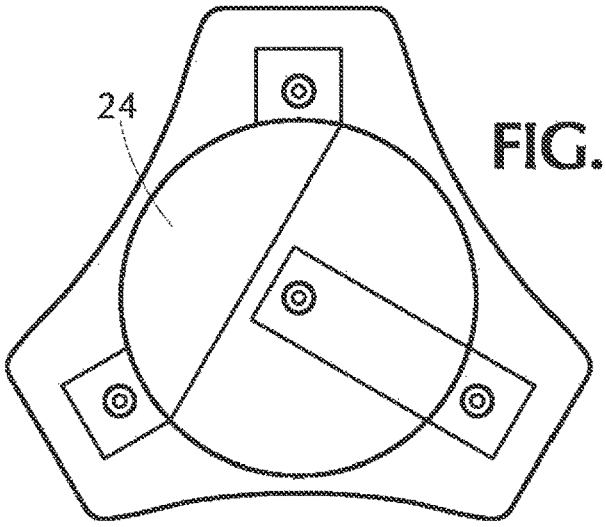
Figure 28A:
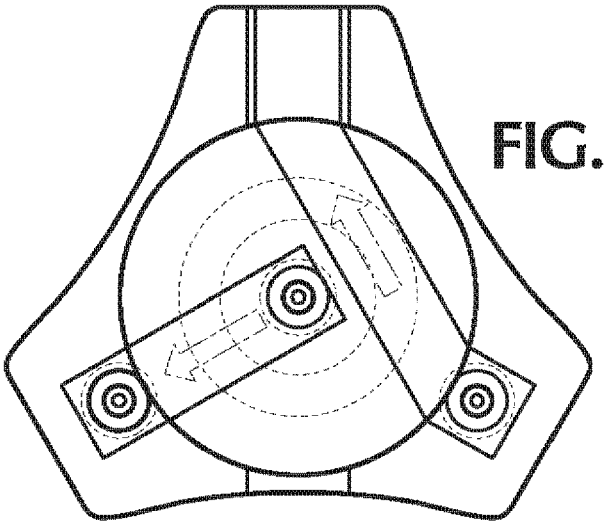
Figure 28B:
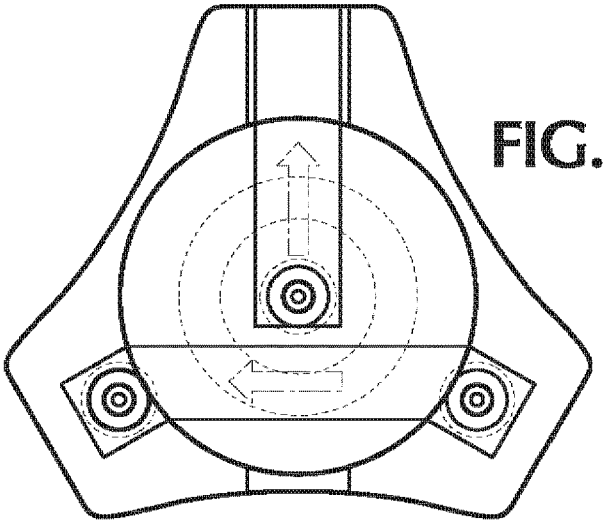
Figure 28C:
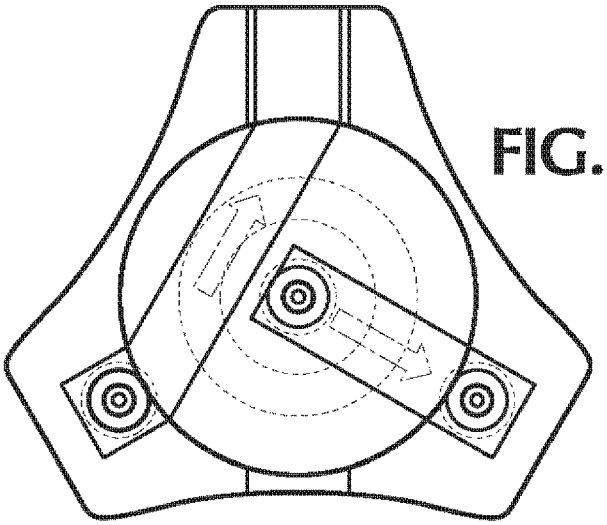
Figure 29A:
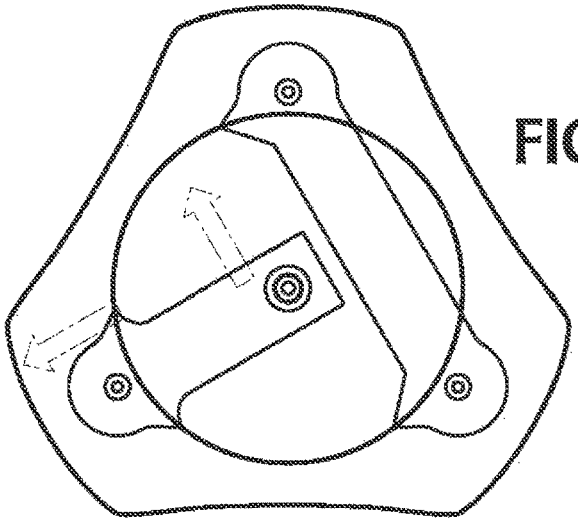
Figure 29B:
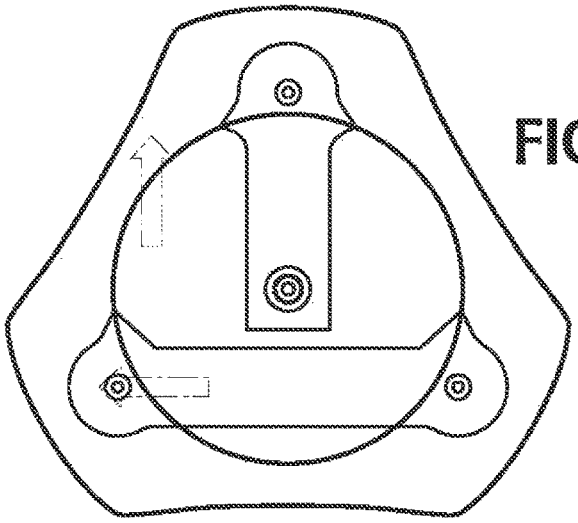
Figure 29C:
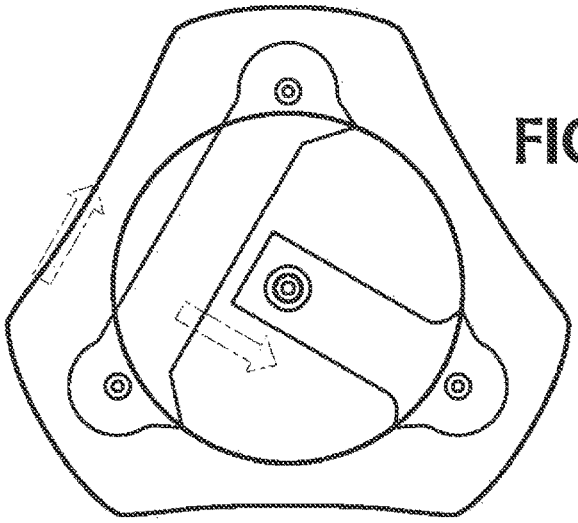
Figure 30A:
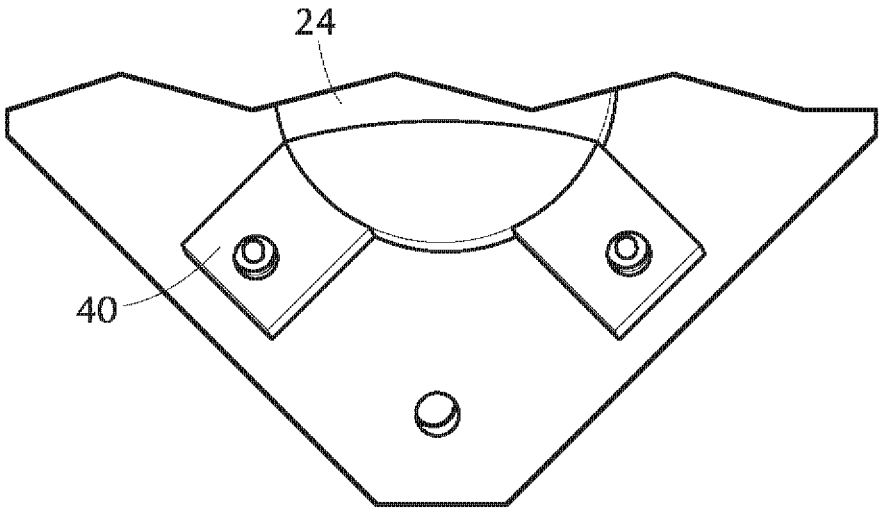
Figure 30B:
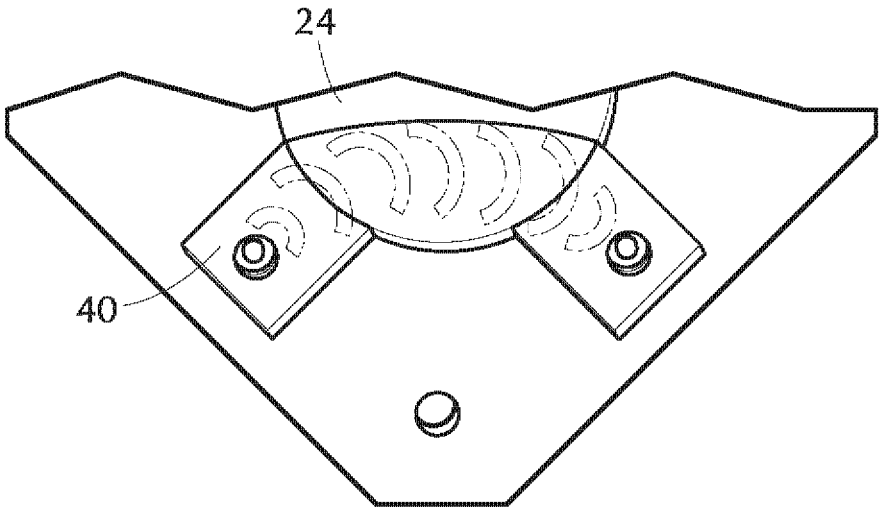
Figure 31A:
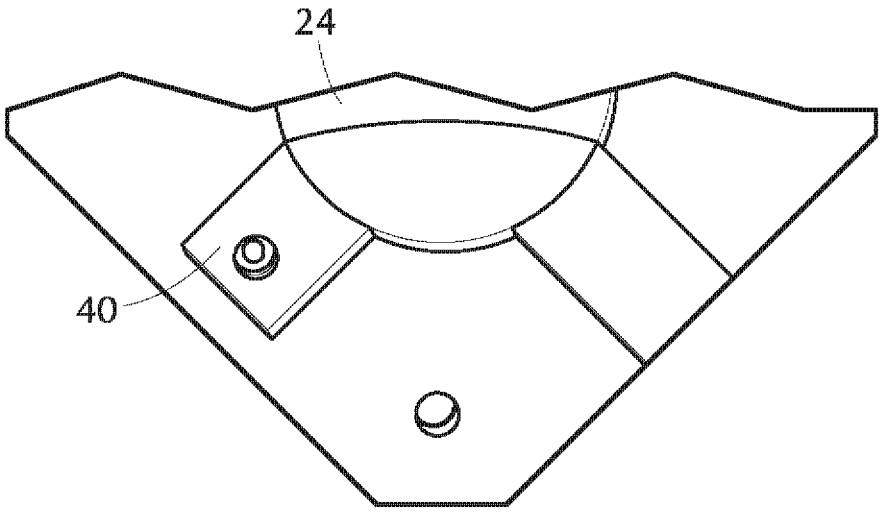
Figure 31B:
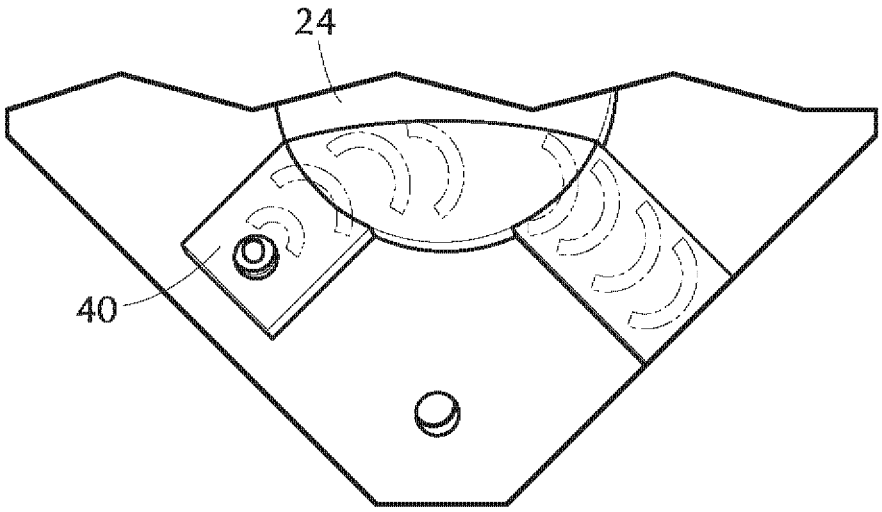

FIG. 22A is a diagrammatic view of a T-Switch with 3 coaxial connectors and 1 waveguide;

FIG. 22B is a diagrammatic view of a T-Switch with 4 coaxial connectors;

FIG. 23 is a diagrammatic view of a T-Switch with 3 coaxial connectors and 1 waveguide port;

FIG. 24 is a diagrammatic perspective view of a T-Switch rotor;

FIG. 25A is a diagrammatic perspective view of a T-Switch with 3 coaxial connectors and 1 waveguide port;

FIG. 25B is a diagrammatic perspective view taken in the direction of ARROW 25B in FIG. 25A of a T-Switch with 3 coaxial connectors and 1 waveguide port;

FIG. 26A is a diagrammatic cross sectional view of a T-Switch with 4 coaxial connectors, a rotor configuration with side walls, and in a first position;

FIG. 26B is a diagrammatic cross sectional view of a T-Switch with 4 coaxial connectors, a rotor configuration with side walls, and in a second position;

FIG. 26C is a diagrammatic cross sectional view of a T-Switch with 4 coaxial connectors, a rotor configuration with side walls, and in a third position;

FIG. 27A is a diagrammatic cross sectional view of a T-Switch with 4 coaxial connectors, a rotor configuration without outer walls, and in a first position;

FIG. 27B is a diagrammatic cross sectional view of a T-Switch with 4 coaxial connectors, a rotor configuration without outer walls, and in a second position;

FIG. 27C is a diagrammatic cross sectional view of a T-Switch with 4 coaxial connectors, a rotor configuration without outer walls, and in a third position;

FIG. 28A is a diagrammatic cross sectional view of a T-Switch with 3 coaxial connectors and 1 waveguide port, and in a first position;

FIG. 28B is a diagrammatic cross sectional view of a T-Switch with 3 coaxial connectors and 1 waveguide port, and in a second position;

FIG. 28C is a diagrammatic cross sectional view of a T-Switch with 3 coaxial connectors and 1 waveguide port, and in a third position;

FIG. 29A is a diagrammatic cross sectional view of a T-Switch with 4 coaxial connectors, and in a first position;

FIG. 29B is a diagrammatic cross sectional view of a T-Switch with 4 coaxial connectors, and in a second position;

FIG. 29C is a diagrammatic cross sectional view of a T-Switch with 4 coaxial connectors, and in a third position;

FIG. 30A is a partial diagrammatic cross sectional view inside the housing of the rotor, and having 2 coax connectors;

FIG. 30B is a partial diagrammatic cross sectional view inside the housing of the rotor of FIG. 30A showing the flow of energy inside the housing from a coax to a coax;

FIG. 31A is a partial diagrammatic cross sectional view inside the housing of the rotor and having 1 coax input and 1 waveguide port output; and FIG. 31B is a partial diagrammatic cross sectional view inside the housing of the rotor of FIG. 31A showing the flow of energy inside the housing from a coax to a waveguide port.

LIST OF REFERENCE NUMERALS UTILIZED IN THE FIGURES OF THE DRAWING

Introductory

20 non-contact type coaxial switch of embodiments of present invention

Overall Configuration of Non-Contact Type Coaxial Switch 20

22 stator/coax base assembly
24 rotor

Specific Configuration of Stator/Coax Base Assembly 22

26 coax base of stator/coax base assembly 22 for resting on support surface 34
28 connectors for engaging with coaxial cable ends, respectively, including poles and throws
34 support surface

Specific Configuration of Rotor 24

36 waveguide ports of rotor 24
38 bearings of rotor 24
40 housing of rotor 24

DETAILED DESCRIPTION OF THE PREFERRED EMBODIMENTS

Double-Pole-Double-Throw (DPDT) Cowave Switch

Introductory

Figure 1A:
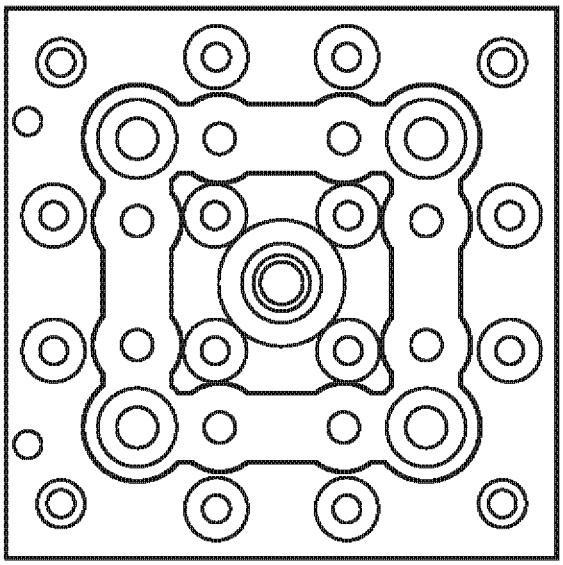
FIG. 1A PRIOR ART
FIG. 1A is a diagrammatic top plan view of a typical Coax base for a double pole double throw coax transfer switch by SMI without contact bars.
Figure 1B:
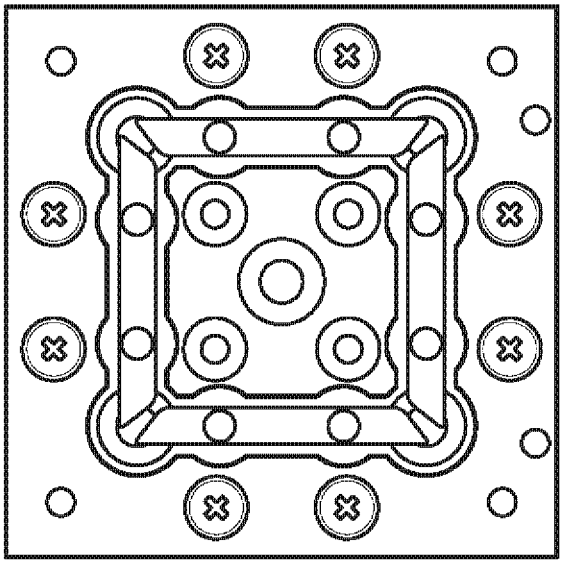
FIG. 1B PRIOR ART
FIG. 1B is a diagrammatic top plan view of a typical Coax base for a double pole double throw coax transfer switch by SMI with contact bars.
Figure 2A:
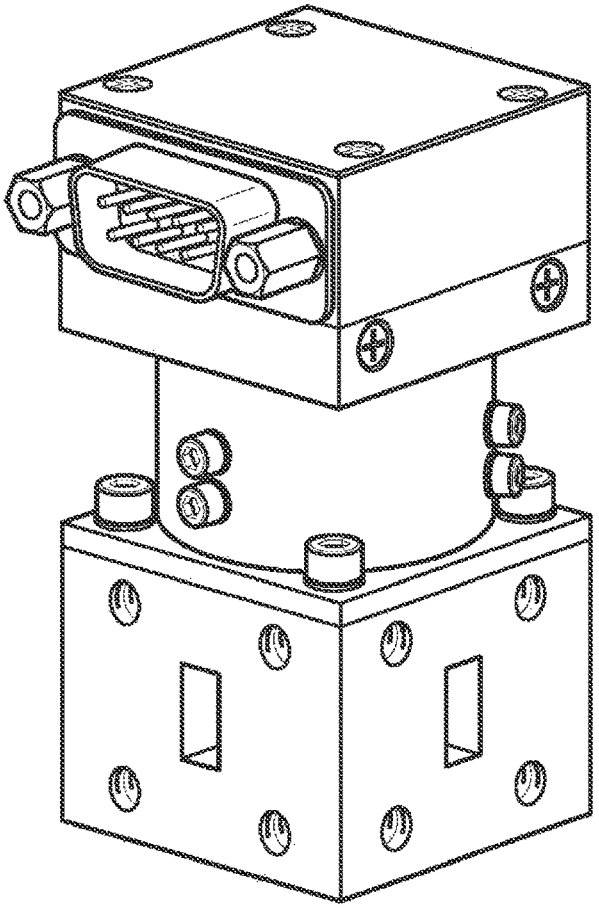
FIG. 2A PRIOR ART
FIG. 2A is diagrammatic perspective view of a typical SMI WR34 Waveguide Transfer Switch.
Figure 2B:
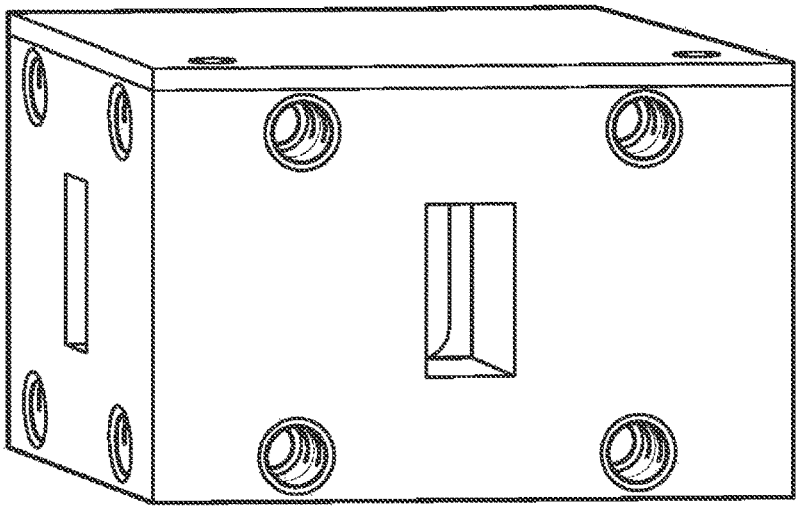
FIG. 2B PRIOR ART
FIG. 2B is an enlarged diagrammatic perspective view of a typical waveguide housing showing two waveguide ports.
Figure 3A:
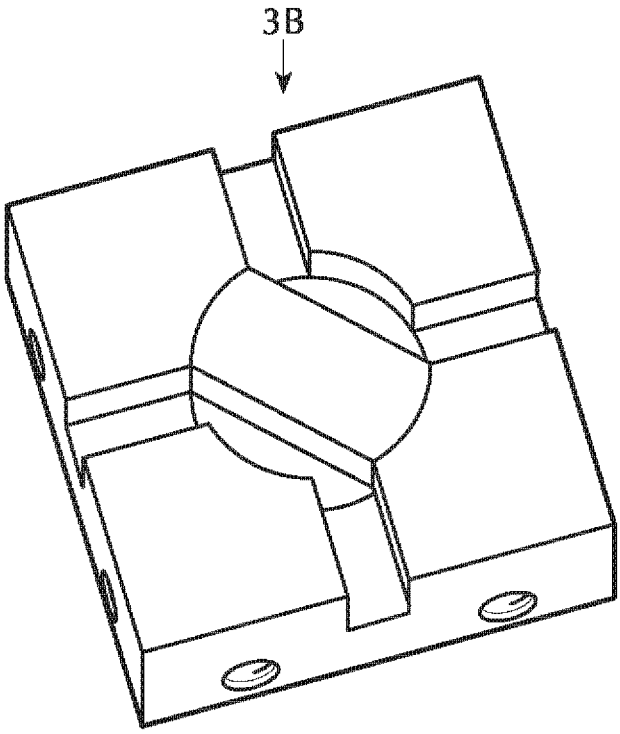
FIG. 3A PRIOR ART
FIG. 3A is a diagrammatic perspective view of a typical Waveguard rotor rotating between two positions inside a waveguide housing for a double pole double throw WR34 Waveguide Transfer Switch.
Figure 3B:
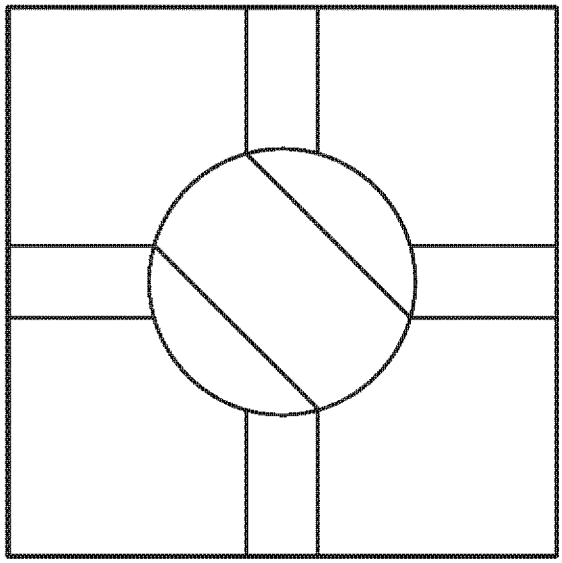
FIG. 3B PRIOR ART
FIG. 3B is a diagrammatic top plan view taken in the direction of ARROW 3B in FIG. 3A of a typical Waveguide rotor rotating between two positions inside a waveguide housing for a double pole double throw WR34 Waveguide Transfer Switch.
Figure 4:
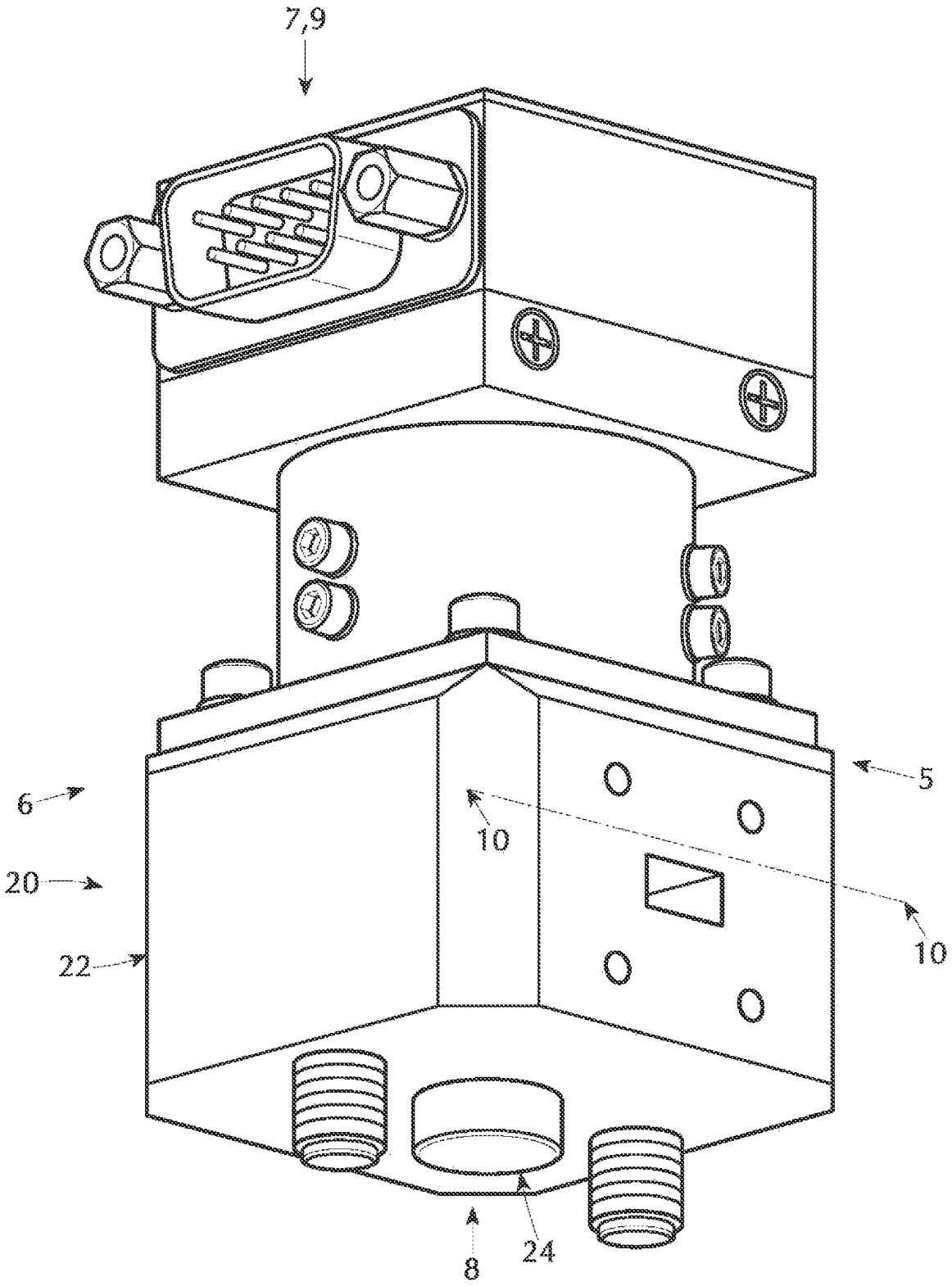
FIG. 4 is a diagrammatic perspective view of the non-contact coaxial switch of the embodiments of the present invention showing two coax connectors and two waveguide ports facing each other.
Figure 5:
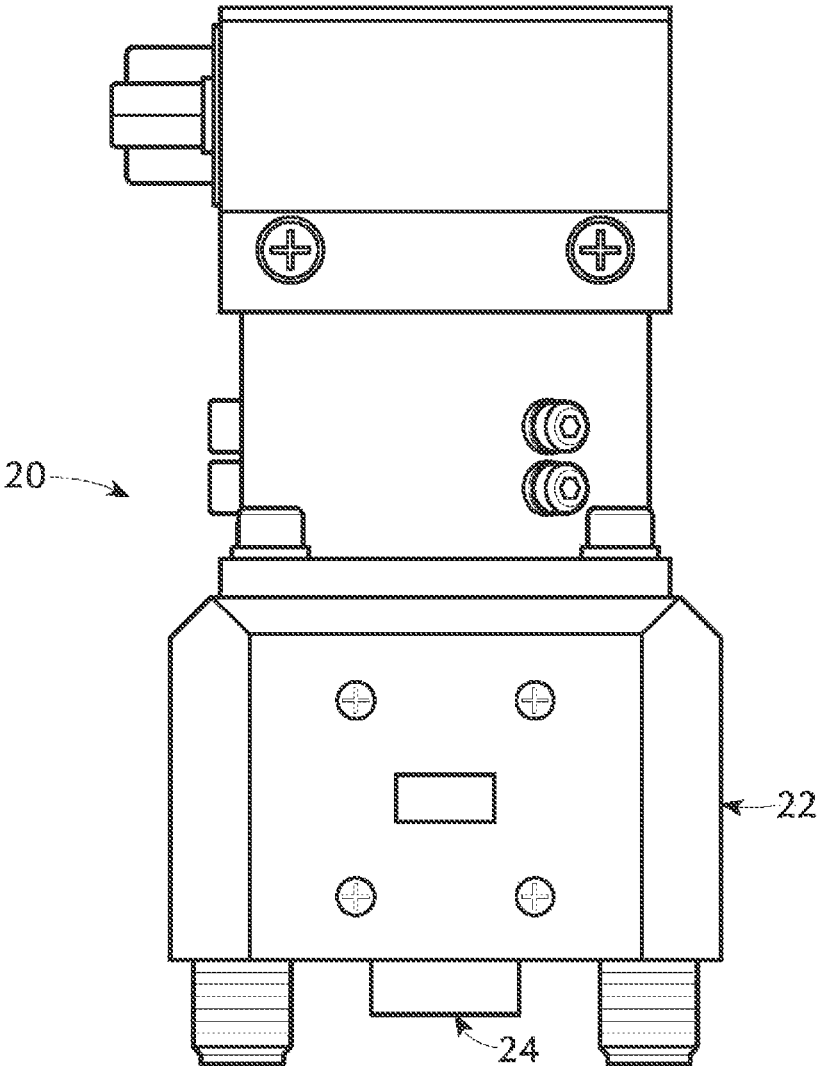
FIG. 5 is a reduced diagrammatic side elevational view taken in the direction of ARROW 5 in FIG. 4 of the non-contact type coaxial switch of the embodiments of the present invention.
Figure 6:
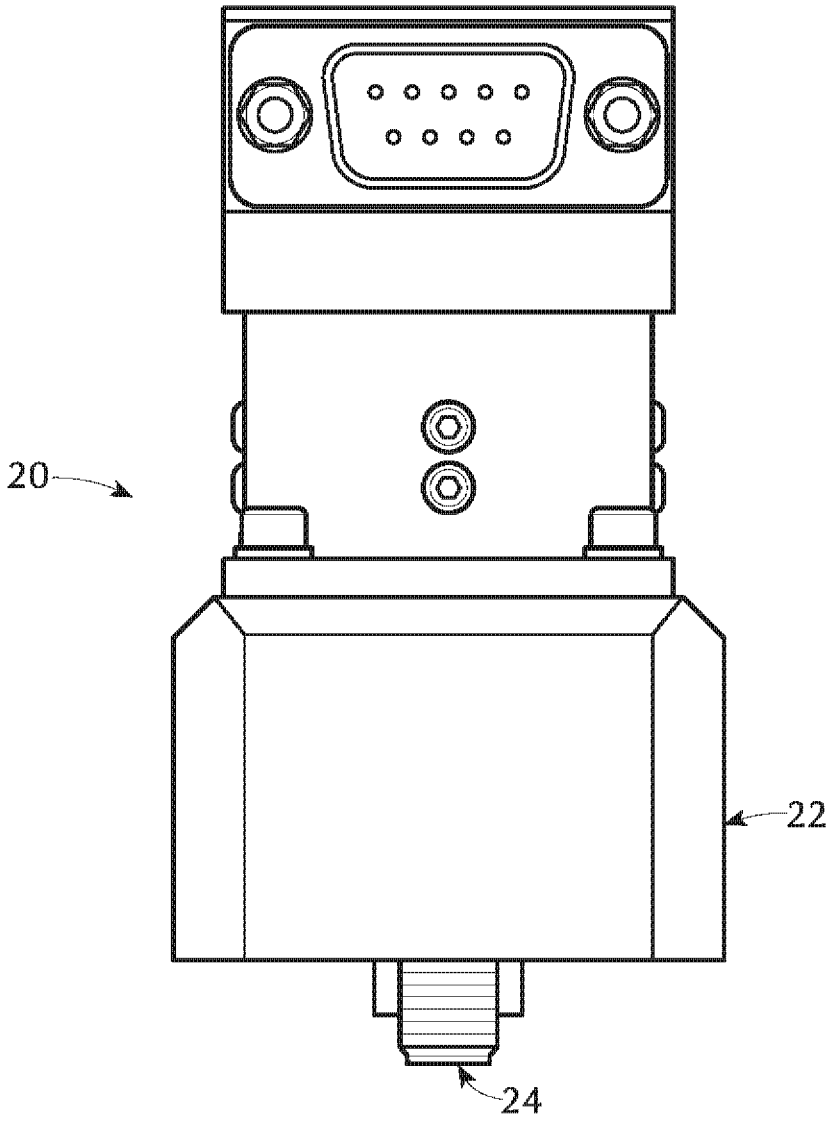
FIG. 6 is a reduced diagrammatic front elevational view taken in the direction of ARROW 6 in FIG. 4 of the non-contact type coaxial switch of the embodiments of the present invention.
Figure 7:
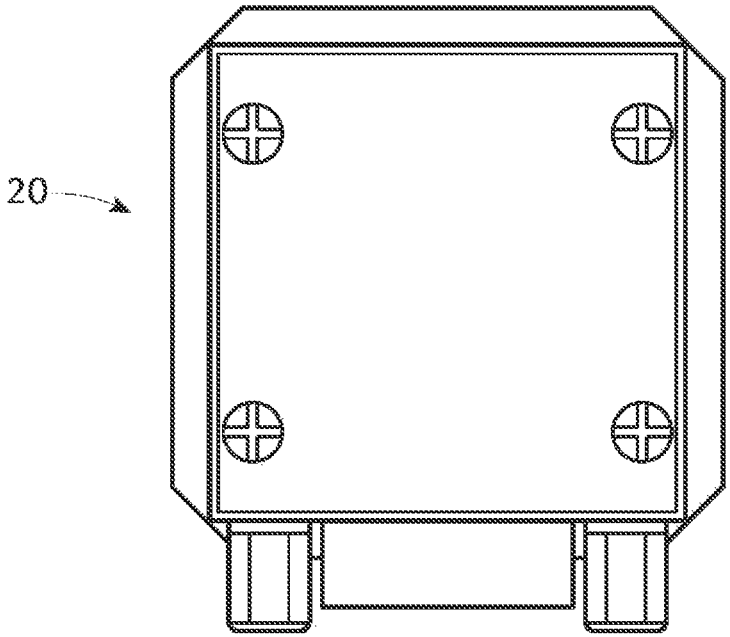
FIG. 7 is a reduced diagrammatic top plan view taken in the direction of ARROW 7 in FIG. 4 of the non-contact type coaxial switch of the embodiments of the present invention.
Figure 8:
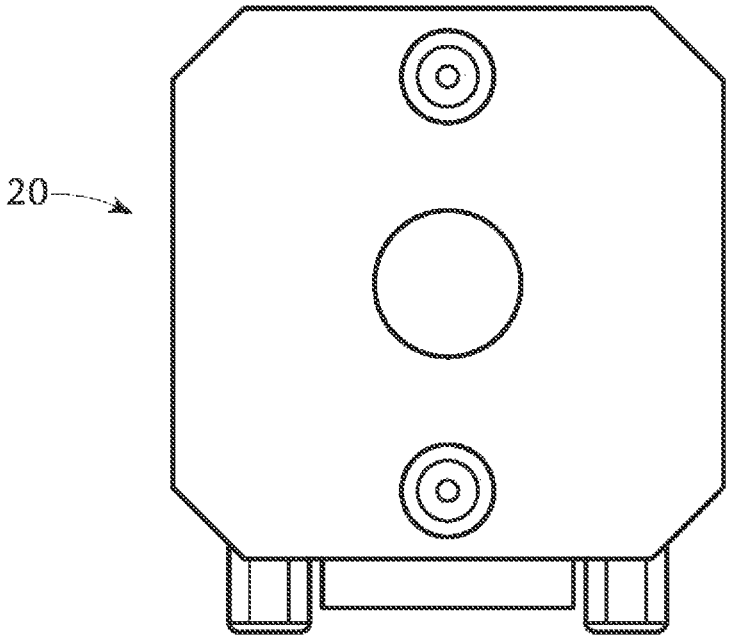
FIG. 8 is a reduced diagrammatic bottom plan view taken in the direction of ARROW 8 in FIG. 4 of the non-contact type coaxial switch of the embodiments of the present invention.
Figure 9:
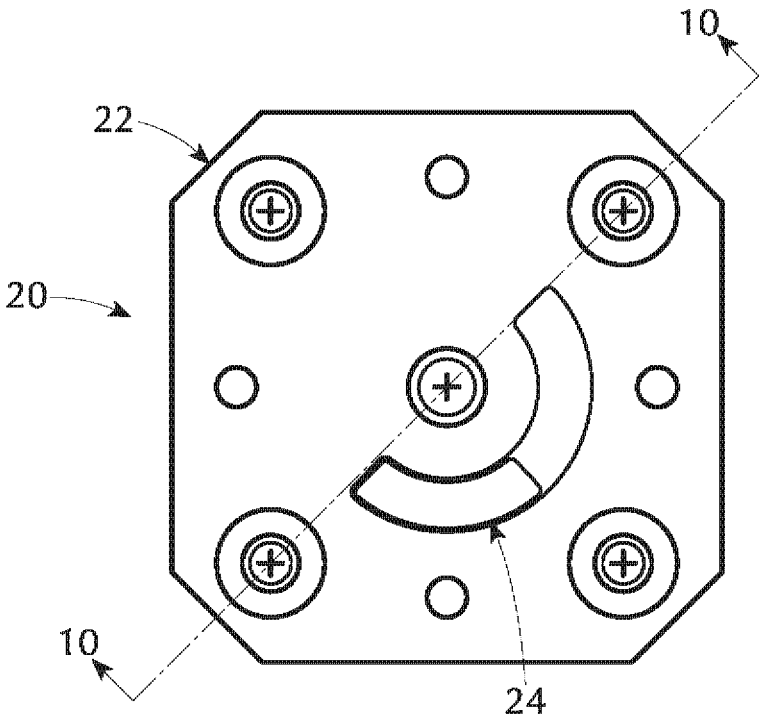
FIG. 9 is a reduced diagrammatic top plan view taken in the direction of ARROW 9 in FIG. 4 of the non-contact type coaxial switch of the embodiments of the present invention.

Referring now to the figures, in which like numerals indicate like parts, and particularly to FIG. 4, the non-contact type coaxial switch of the embodiments of the present invention is shown generally at 20.

The Overall Configuration of the Non-Contact Type Coaxial Switch 20

The overall configuration of the non-contact type coaxial switch 20 can best be seen in FIGS. 4-10, and as such, will be discussed with reference thereto.

The non-contact type coaxial switch 20 comprises a stator/coax base assembly 22 and a rotor 24. The stator/coax base assembly 22 is fixed. The rotor 24 is rotatably mounted to the stator/coax base assembly 22, and is for eliminating all of the contacts and the inner conductors.

The non-contact type coaxial switch 20 is one of a complete coax switch and a waveguide switch, and arrangements therebetween.

The Specific Configuration of the Stator/Coax Base Assembly 22

The specific configuration of the stator/coax base assembly 22 can best be seen in FIG. 10, and as such, will be discussed with reference thereto.

The stator/coax base assembly 22 is external to the rotor 24 for user's use.

The stator/coax base assembly 22 includes a coax base 26 and connectors 28.

The coax base 26 of the stator/coax base assembly 22 is for resting on a support surface 34. The connectors 28 of the stator/coax base assembly 22 are for engaging with coaxial cable ends, respectively, including poles and throws.

The Specific Configuration of the Rotor 24

The specific configuration of the rotor 24 can best be seen in FIGS. 10, 11A, 11B, 12, 13A, and 13B, and as such, will be discussed with reference thereto.

Figure 10:
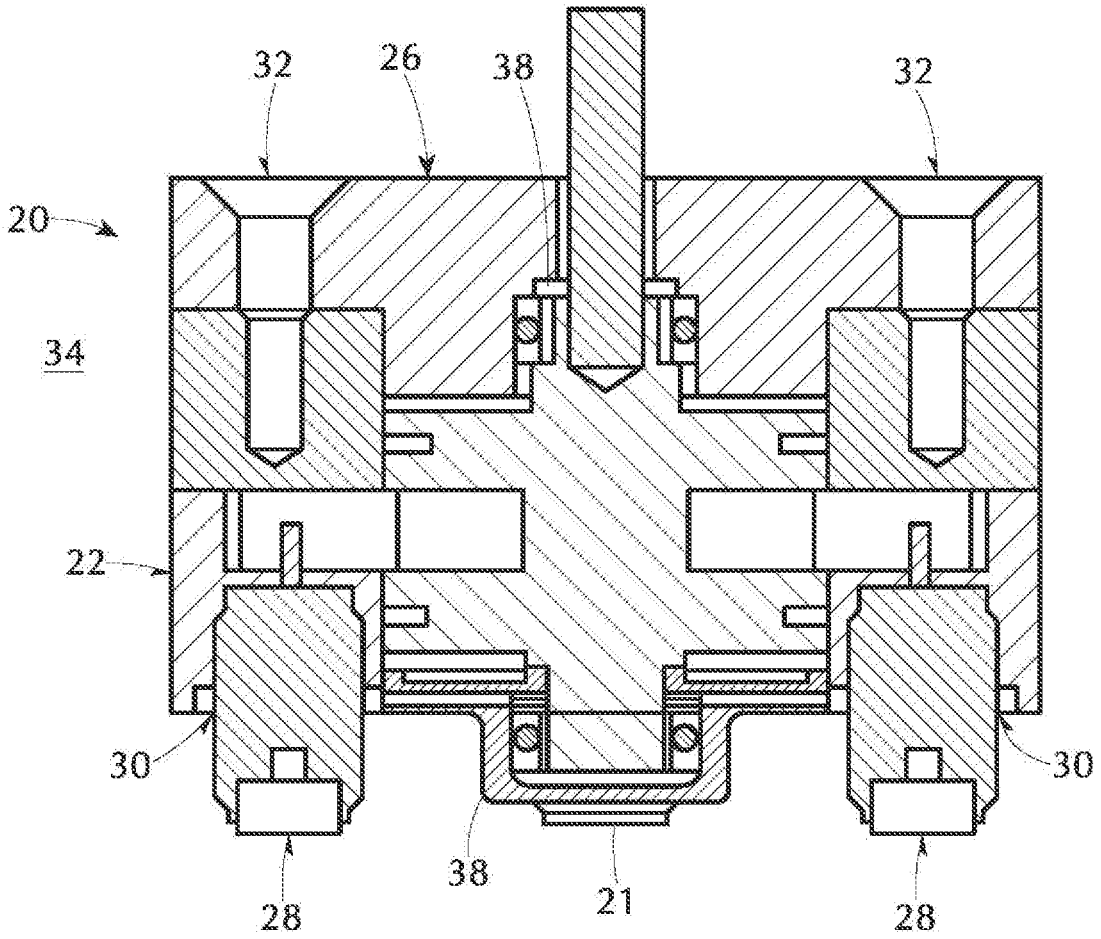
FIG. 10 is a diagrammatic cross sectional view taken along LINE 10-10 in FIG. 4.

As shown in FIG. 10, the rotor 24 is internal to the stator/coax base assembly 22, and rotates on bearings 38.

The rotor 24 is a waveguide that performs a switching function so as to allow for the non-contact and no inner conductors 20.

The rotor 24 is a section of the waveguide that is rotated between the coax connectors 28 of the stator/coax base assembly 22 to complete circuit.

The rotor 24 can be one of vertical (E plane) and horizontal (H plane), with the non-contact type coaxial switch 20 designed accordingly.

The rotor 24 is capable to switching to feed the coax outputs to form a waveguide switch with internal coax outputs.

A typical waveguide switch is a waveguide rotor that switches to input the waveguide to the waveguide outputs.

Below are 5 randomly picked examples that the non-contact type coaxial switch 20 can assume:

Example 1

Figure 11A:
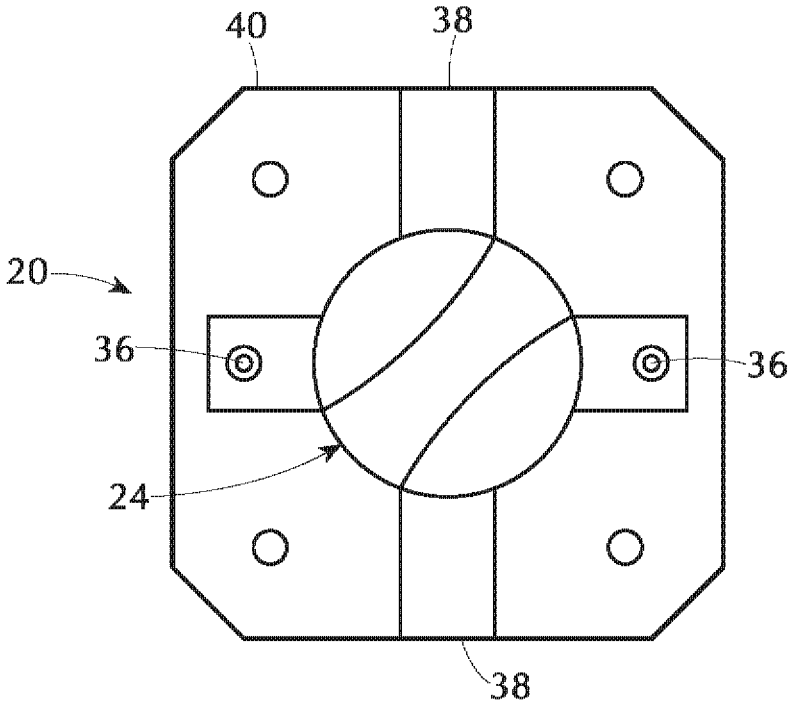
FIG. 11A is a diagrammatic cross sectional view illustrating the two waveguide ports and 2 coax connectors.

As shown in FIG. 11A, the non-contact type coaxial switch 20 has two waveguide ports 36 and 2 coax connectors.

Example 2

Figure 11B:
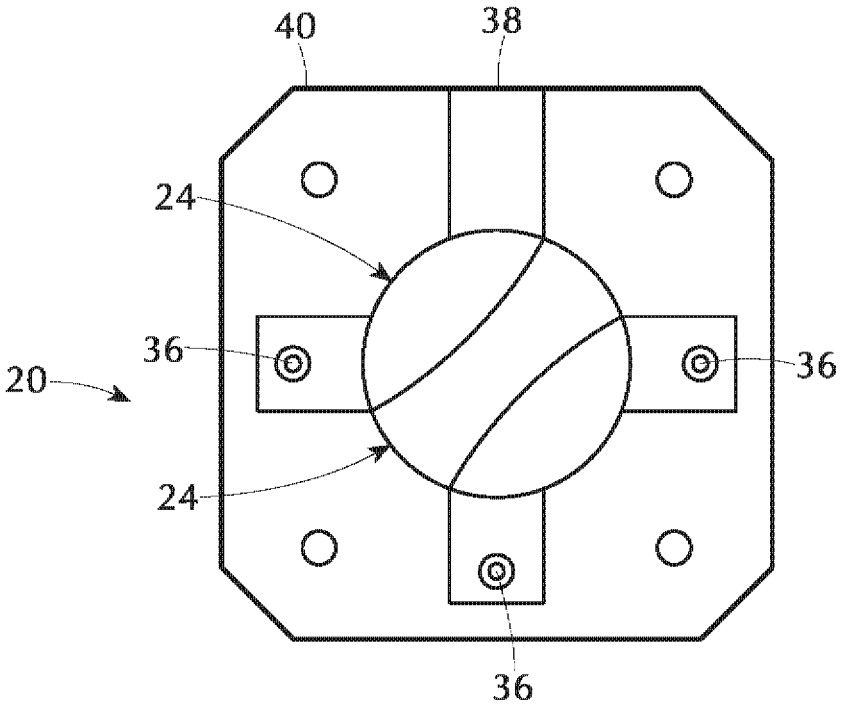
FIG. 11B is a diagrammatic cross sectional view illustrating the 3 connectors with one waveguide port configuration.
Figure 12:
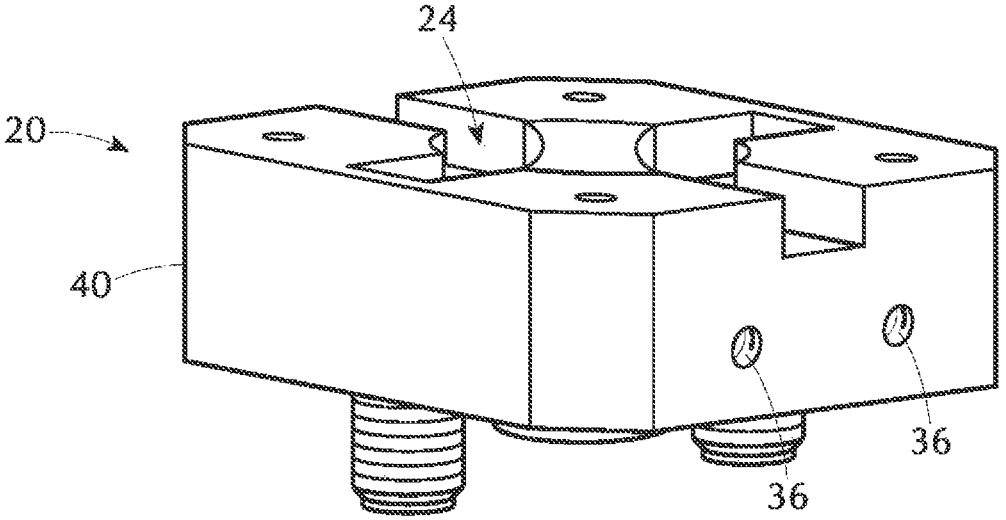
FIG. 12 is a diagrammatic cross sectional view illustrating the rotor and the housing with 2 waveguide ports.

As shown in FIG. 11B the non-contact type coaxial switch 20 has 3 coax connectors with 1 waveguide port configuration.

Example 3

Figure 13A:
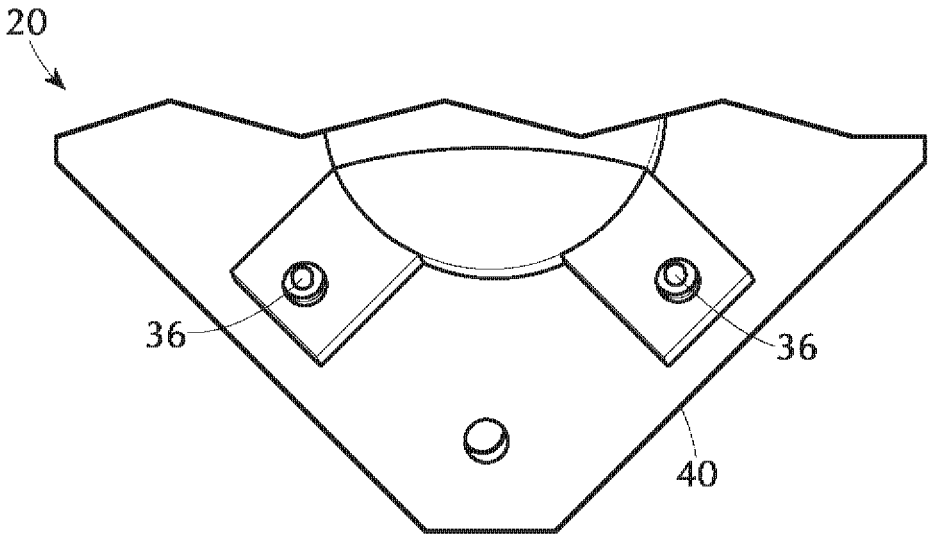
FIG. 13A is a diagrammatic cross sectional view of the present invention illustrating the flow of energy inside the housing from a coax to a coax.

As shown in FIG. 13A, the non-contact type coaxial switch 20 has the flow of energy inside the housing 40 from a coax to a coax.

Example 4

Figure 13B:
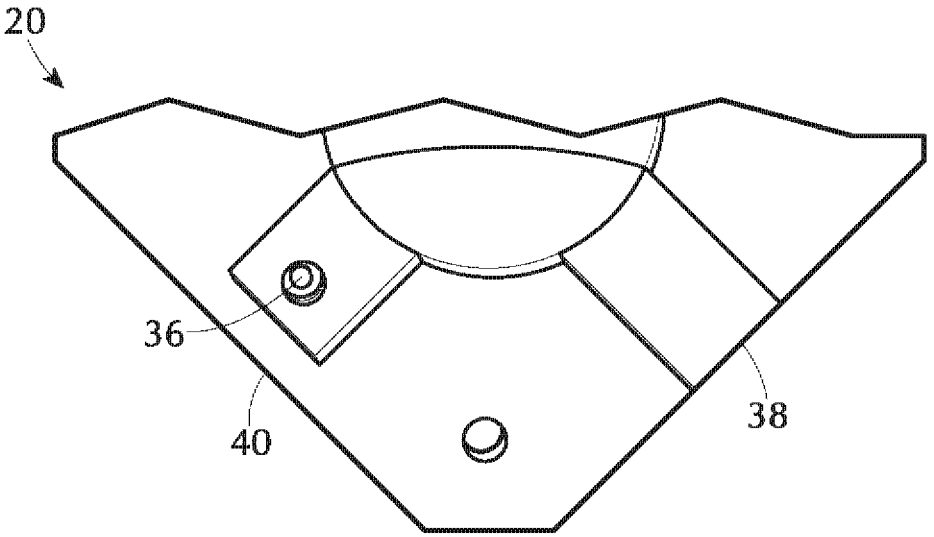
FIG. 13B is a diagrammatic cross sectional view of the present invention illustrating the flow of energy inside the housing from a coax to a waveguide port.

As shown in FIG. 13B, the non-contact type coaxial switch 20 has the flow of energy inside the housing 40 from a coax to a waveguide port.

Example 5

The non-contact type coaxial switch 20 has 3 waveguides and 1 coax.

Example 6

The non-contact type coaxial switch 20 has 4 waveguides.

Moving on now, the rotor 24 transmits the signal across two paths. The rotor 24 can be flat or curved, with a side wall or without a side wall, as shown in FIGS. 18A-18D, 19A, 19B, 20A-20D, 21A, and 21B inputs and outputs are coaxial connectors, waveguide ports, or combination thereof.

As shown in FIG. 14, the rotor 24 can have side walls, a top wall, a bottom wall, or any combination thereof, and behaves like a waveguide switching device;

Each port can be a waveguide port or a coaxial connector, and therefore, a plurality of possible combinations of coax switches, waveguide switches, and hybrid combinations of waveguide ports and coaxial connectors are possible.

As shown in FIGS. 15A-15C, 16A-16D, 17A, and 17B, the coaxial connector can be mounted from the bottom side of the housing 40, the outer side of the housing 40, or the front of the housing 40, respectively.

The waveguide channels may have single or double ridges, and not just plain, rectangular channels.

With the concept of being able to stack switch housings 40, the same switch 20 can have multiple rotors 24 stacked on top of each other, so as to be able to form arrays of the switches.

As shown in FIGS. 16A-16D, a curved rotor 24 can have curved outer walls for a DPDT switch, and shown in first, second, third, and fourth positions, respectively.

As shown in FIGS. 17A and 17B, a flat rotor 24 can have no outer wall for a DPDT switch, and shown in first and second positions, respectively.

3 and 4-Way R-Type Configuration

As shown in FIGS. 18A and 18B, an R-switch can have 3 or 4 position switching, adjacent paths, and a through path, and shown in first and second positions, respectively.

As shown in FIGS. 18C and 18D, an R-switch can have 4 coaxial connectors, and shown in first and second positions, respectively.

As shown in FIGS. 19A and 19B, a 4-way position rotor 24 can have no top wall or side walls.

Single-Pole-Multiple-Throw (SPMT) Configuration

As shown in FIGS. 20A-20D, a switch can have 4 coaxial connectors and 4 waveguide ports, which provide a single input switchable to "X" output of coax or waveguide ports, and shown in first, second, third, and fourth positions, respectively.

As shown in FIG. 21A, an SPMT rotor 24 can have no bottom wall and can have a flat side.

As shown in FIG. 21B, an SPMT rotor 24 can have no bottom wall and can have a curved side.

T-Switch Configuration

As shown in FIG. 22A, a T-Switch can have 3 coaxial connectors and one waveguide.

As shown in FIG. 22B, a T-Switch can have 4 coaxial connectors.

As shown in FIG. 23, a T-Switch can have 3 coaxial connectors and 1 waveguide port.

Shown in FIG. 24 is a T-Switch rotor 24.

As shown in FIGS. 25A and 25B, a T-Switch can have 3 coaxial connectors and 1 waveguide port.

As shown in FIGS. 26A-26C, a T-Switch can have 4 coaxial connectors, a rotor 24 with side walls, and shown in first, second, and third positions, respectively.

As shown in FIGS. 27A-27C, a T-Switch can have 4 coaxial connectors, a rotor 24 without outer walls, and shown in first, second, and third positions, respectively.

As shown in FIGS. 28A-28C, a T-Switch can have 3 coaxial connectors and 1 waveguide port, and shown in first, second, and third positions, respectively.

As shown in FIGS. 29A-29C, a T-Switch can have 4 coaxial connectors, and shown in first, second, and third positions, respectively.

As shown in FIG. 30A, the inside of the housing 40 of the rotor 24 can have 2 coax connectors.

As shown in FIG. 30B, inside of housing 40 of the rotor 24 can have a flow of energy from a coax to a coax.

As shown in FIG. 31A, the housing 40 of the rotor 24 can have 1 coax input and 1 waveguide port output.

As shown in FIG. 31B, inside the housing 40 of the rotor 24 can have a flow of energy from a coax to a waveguide port.

IMPRESSIONS

It will be understood that each of the elements described above, or two or more together, may also find a useful application in other types of constructions differing from the types described, supra.

While the embodiments of the present invention have been illustrated and described as embodied in a non-contact type coaxial switch, nevertheless, they are not limited to the details shown, since it will be understood that various omissions, modifications, substitutions, and changes in the forms and details of the embodiments of the present invention illustrated, and their operation, can be made by those skilled in the art without departing in any way from the spirit of the embodiments of the present invention.

Without further analysis, the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A non-contact coaxial switch, comprising:

a stator/coax base assembly including a coax base having connectors for engaging an end of coaxial cable; wherein said coax base of said stator/coax base assembly is configured for resting on a support surface; and a rotor rotatably mounted to said stator/coax base assembly, said rotor eliminating all contacts and inner conductors and being a waveguide that switches to feed coax outputs to form a waveguide switch with internal coax outputs, said non-contact coaxial switch being capable of switching between at least one waveguide port and coax inputs and coax outputs; wherein coax connectors work as an antenna and sends said signal through a waveguide channel to a receiving connector.

2. The non-contact coaxial switch of claim 1, wherein said stator/coax base assembly is external to said rotor.

3. The non-contact coaxial switch of claim 1, wherein said rotor is internal to said stator/coax base assembly.

4. The non-contact coaxial switch of claim 1, wherein said rotor is a section of said waveguide that is rotated between said connectors of said stator/coax base assembly to complete a circuit.

5. The non-contact coaxial switch of claim 1, wherein said non-contact type coaxial switch includes two waveguide ports and two coax connector configurations.

6. The non-contact coaxial switch of claim 1, wherein said non-contact type coaxial switch includes three connectors with one waveguide port configuration.

7. The non-contact coaxial switch of claim 1, wherein said non-contact coaxial switch includes a housing with a flow of energy inside said housing from a first coax connector to a second coax connector.

8. The non-contact coaxial switch of claim 1, wherein said non-contact coaxial switch includes a housing with a flow of energy inside said housing from a coax to a waveguide port.

9. The non-contact coaxial switch of claim 1, wherein said rotor is capable of switching to feed said coax outputs to form said waveguide switch with internal coax outputs, between four coaxial inputs/outputs.

10. The non-contact coaxial switch of claim 1, wherein said non-contact coaxial switch has three waveguides and one coax.

11. The non-contact coaxial switch of claim 1, wherein said non-contact coaxial switch has four waveguides.

12. The non-contact coaxial switch of claim 1, wherein said rotor transmits a signal between two said connectors across two paths.

13. The non-contact coaxial switch of claim 1, wherein said waveguide switch of said rotor is an R-switch having three- or four-position switching, adjacent paths and a through path.

14. The non-contact coaxial switch of claim 13, wherein said R-switch has four coaxial connectors.

15. The non-contact coaxial switch of claim 1, wherein said waveguide switch of said rotor is a T-Switch having three coaxial connectors and one waveguide.

16. The non-contact coaxial switch of claim 1, wherein said waveguide switch of said rotor a T-Switch has four coaxial connectors.

* * * * *